US011596284B2

(12) United States Patent
Martin et al.

(10) Patent No.: US 11,596,284 B2
(45) Date of Patent: Mar. 7, 2023

(54) VACUUM TOOL WITH MULTIPLE USE BLADES

(71) Applicant: SHOP VAC CORPORATION, Williamsport, PA (US)

(72) Inventors: Jason Lee Martin, Hallstead, PA (US); Neil N. Norell, Candor, NY (US); Michael Z. Yurko, Endicott, NY (US)

(73) Assignee: SHOP VAC CORPORATION, Williamsport, PA (US)

( * ) Notice: Subject to any disclaimer, the term of this patent is extended or adjusted under 35 U.S.C. 154(b) by 627 days.

(21) Appl. No.: 16/481,403

(22) PCT Filed: Mar. 1, 2018

(86) PCT No.: PCT/US2018/020389
§ 371 (c)(1),
(2) Date: Jul. 26, 2019

(87) PCT Pub. No.: WO2018/160789
PCT Pub. Date: Sep. 7, 2018

(65) Prior Publication Data

US 2019/0387937 A1 Dec. 26, 2019

Related U.S. Application Data

(60) Provisional application No. 62/489,636, filed on Apr. 25, 2017, provisional application No. 62/466,912, filed on Mar. 3, 2017.

(51) Int. Cl.
*A47L 9/06* (2006.01)

(52) U.S. Cl.
CPC ..... *A47L 9/0613* (2013.01); *A47L 9/0626* (2013.01); *A47L 9/0673* (2013.01)

(58) Field of Classification Search
CPC ..... A47L 9/0673; A47L 9/0626; A47L 9/0613
See application file for complete search history.

(56) References Cited

U.S. PATENT DOCUMENTS 1,083,087 A * 12/1913 Griffiths ..... A47L 9/02 15/314
1,597,855 A * 8/1926 Zahorsky ..... A45D 24/32 401/289

(Continued)

FOREIGN PATENT DOCUMENTS

DE 10302728 A1 * 8/2004 ..... A47L 9/06
EP 1173085 A1 1/2002
WO WO-00/65979 A1 11/2000

OTHER PUBLICATIONS

International Search Report and Written Opinion, corresponding International Application No. PCT/US2018/020389, dated Apr. 24, 2018.

*Primary Examiner* — Bryan R Muller
(74) *Attorney, Agent, or Firm* — Marshall, Gerstein & Borun LLP

(57) ABSTRACT

A vacuum accessory may include a head including a head body defining an inlet and a fitting interface, the head body extending from a fitting interface to a base and enclosing a cavity. A fitting includes a fitting body symmetrically disposed about a longitudinal axis of the fitting. The fitting body defines a fitting inlet, an outlet, and a flow path connecting the fitting inlet and the outlet. The fitting is connected to the head at the fitting interface and a fluid flow path fluidly connects the inlet and the outlet. A blade is removably coupled to the head and at least partially disposed within the cavity of the head. The blade includes a flat blade body that is coplanar with a reference plane dividing the fitting body and containing the longitudinal axis of the fitting.

25 Claims, 18 Drawing Sheets

(56) References Cited

U.S. PATENT DOCUMENTS

| | | | | |
|---|---|---|---|---|
| 2,243,120 | A * | 5/1941 | Pollitt | A47L 9/0613 15/396 |
| 2007/0056138 | A1* | 3/2007 | Baan | A47L 9/0673 15/398 |
| 2007/0192986 | A1 | 8/2007 | Garcia et al. | |
| 2015/0342335 | A1* | 12/2015 | Nicoline | A46B 9/023 15/160 |
| 2016/0302634 | A1* | 10/2016 | Juergens | A47L 11/4036 |

* cited by examiner

E-E

G-G

I-I

VACUUM TOOL WITH MULTIPLE USE BLADES

CROSS-REFERENCE TO RELATED APPLICATIONS

This application is the U.S. National Phase of International Patent Application No. PCT/US2018/020389 filed Mar. 1, 2018, which in turn claims priority to U.S. Provisional Application Ser. No. 62/466,912 filed on Mar. 3, 2017, and U.S. Provisional Application Ser. No. 62/489,636 filed on Apr. 25, 2017, the entire contents of which are incorporated herein by reference.

FIELD OF DISCLOSURE

The present disclosure generally relates to a tool for a vacuum cleaner, and in particular, a blade and accessory for a vacuum cleaner for cleaning carpeting.

BACKGROUND

A vacuum cleaner generally includes a suction generating apparatus, such as a suction fan, which communicates with an intake orifice to apply suction force to a target area. The intake orifice may be altered when coupled to a vacuum accessory or tool. For example, different vacuum accessories are adapted for use with a vacuum cleaner to address particular cleaning needs and environments. For example, a hand-held vacuum cleaner may be installed in a vehicle sized to be stored when not in use and allow for convenient cleaning.

Generally, vacuum cleaners used in vehicles are limited in suction surface area and suction force due to the size limitations of the vacuum. The vacuums are designed to reach between seats, under seats, in narrow cleaning spaces and fit into a compartment in the car for storage. To reach narrow areas, such as beneath seats, the vacuum may include a narrow accessory or tool with a small suction surface that is adapted to squeeze into narrow spaces and other target cleaning areas. The small suction surface area combined with a smaller vacuum motor may limit the ability of the vehicle vacuum cleaner to clean dirt and pet hair caked into the interior carpeting of the vehicle.

SUMMARY

In accordance with a first exemplary aspect, a vacuum accessory for use with a vacuum cleaner may include a head with a head body defining an inlet and a fitting interface, the head body extending from a fitting interface to a base and enclosing a cavity. A fitting may include a fitting body symmetrically disposed about a longitudinal axis of the fitting, the fitting body defining a fitting inlet, an outlet, and a flow path connecting the fitting inlet and the outlet, the fitting being connected to the head at the fitting interface. A fluid flow path may fluidly connect the inlet and the outlet, where the fluid flow path may be at least partially defined by the head body and the fitting body. The vacuum accessory may include a blade coupled to the head and at least partially disposed within the cavity of the head, the blade including a flat blade body. A reference plane may divide the fitting body and containing the longitudinal axis of the fitting, wherein the reference plane may be coplanar with the flat blade body when the blade is coupled to the head so that the blade is positioned substantially parallel with the fluid flow path.

In a second exemplary aspect, a vacuum accessory for use with a vacuum cleaner may include a head with a base and an enclosed body having a fitting interface and defining an inlet. A fitting may include a body defining a fitting inlet, an outlet, and a flow path connecting the fitting inlet and the outlet, wherein the fitting may be connected to the head at the fitting interface. A fluid flow path may fluidly connect the inlet and the outlet and at least partially defined by the enclosed body of the head and the body of the fitting. A blade may be removably coupled to the head and at least partially disposed within the enclosed body. The blade may include a blade body having a bottom edge, wherein the bottom edge may extend beyond a base of the head when the blade is coupled to the head.

In further accordance with any one or more of the first and second exemplary aspects, the accessory may include any one or more of the following forms.

In a preferred form of the accessory, the blade may include a bottom edge, a top edge, and a back edge. When the blade is coupled to the head, the blade body may be centrally disposed within the head body, the top edge may be coupled to the head, the back edge may be disposed within the cavity, and the bottom edge may be disposed in the inlet and extend from a bottom surface of the base.

In a preferred form of the accessory, the head may include a track formed in the head body, the track including a first end, a second end, and a slot connecting the first end and the second end and being sized to receive the top edge of the blade.

In a preferred form of the accessory, the top edge of the blade may include a fastening member adapted to removably couple to a receiving aperture at the first end of the track.

In a preferred form, the blade may include a deformable tab, and the head and the fitting may include an aperture sized to receive the deformable tab. The deformable tab may include an angled end adapted to engage with the head, the deformable tab adapted to deform outwardly away from blade body to disengage the angled end from the head the when the blade is decoupled from the head and the fitting.

In a preferred form of the accessory, the bottom edge of the blade may include a rubber attachment configured to attract hair and other debris from a cleaning surface.

In a preferred form of the accessory, the bottom edge of the blade may include a plurality of bristles.

In a preferred form of the accessory, the fitting may be configured to attach the head to a nozzle of a vacuum at the outlet.

In a preferred form of the accessory, the head body may include a plurality of walls forming the cavity, each of the plurality of walls having a top portion and a bottom edge, wherein the bottom edges of the walls form the base and the top portions of the walls form the fitting interface.

In a preferred form of the accessory, the base may be disposed on a horizontal plane and includes a rounded triangular-shaped perimeter.

In a preferred form of the accessory, the head may include a cover portion defined by the plurality of top portions of the walls, and wherein the plurality of walls include a leading portion, a first and second symmetrical side portions, and a back portion.

In a preferred form of the accessory, the first and second symmetrical side portions may be angled inwardly toward the cover portion.

In a preferred form of the accessory, the bottom edge of the blade may extend beyond the bottom edges of the plurality of walls of the head in a direction perpendicular to the horizontal plane of the base.

In a preferred form of the accessory, the top edge of the blade may sealingly mate with an exterior surface of the track formed in the head.

In a preferred form, the accessory may include a reference plane dividing the fitting and intersecting with a longitudinal axis of the fitting, wherein the reference plane may be coplanar with the blade body.

In a preferred form of the accessory, the blade may sealingly mate with an interior surface of the head.

In a preferred form of the accessory, the bottom edge of the blade may extend beyond the bottom edges of the plurality of walls of the head in a direction perpendicular to a bottom surface of the base.

In a preferred form of the accessory, the blade may include a bottom edge, a top edge, and a back edge. When the blade is coupled to the head and fitting, the top edge of the blade may be adjacent to the enclosed body, the back edge may be disposed within the enclosed body, and the bottom edge may extend through the inlet.

In a preferred form of the accessory, the enclosed body of the head may include a plurality of walls forming an enclosed area, each of the walls having a top portion and a bottom edge, wherein the bottom edges of the walls form a base and the top portions of the walls form the fitting interface.

In a preferred form of the accessory, the head may include a cover portion defined by the plurality of top portions of the walls, and wherein the plurality of walls include a leading portion, a first and second symmetrical side portions, and a back portion.

BRIEF DESCRIPTION OF THE DRAWINGS

The features of this invention which are believed to be novel are set forth with particularity in the appended claims. The invention may be best understood by reference to the following description taken in conjunction with the accompanying drawings, in which like reference numerals identify like elements in the several Figures, in which:

DETAILED DESCRIPTION

Figure 1:
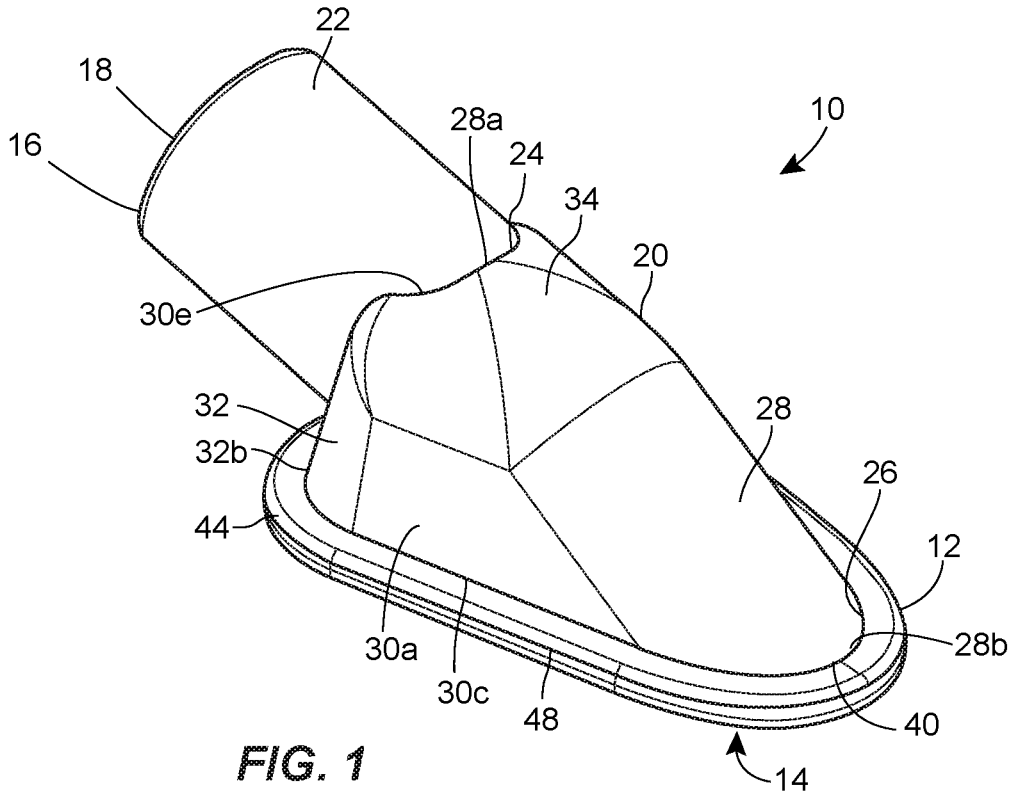
FIG. 1 is a perspective view of a first example vacuum accessory constructed in accordance with the principles of the present disclosure.

Although the following text sets forth a detailed description of one or more examples of the invention, it should be understood that the legal scope of the invention is defined by the words of the claims set forth at the end of this patent. The following detailed description is to be construed as exemplary only and does not describe every possible example of the invention, as describing every possible example would be impractical, if not impossible. Numerous alternative examples could be implemented, using either current technology or technology developed after the filing date of this patent, and such alternative examples would still fall within the scope of the claims defining the invention.

A vacuum accessory 10 according to aspects of the present disclosure may effectively attract and remove hair, dust, and debris from surfaces and, in particular, hard-to-reach areas and narrow spaces. In some configurations, the accessory 10 may easily attach to a vacuum hose, disassemble to replace individual parts, and/or may combine with an additional cleaning accessory. The vacuum accessory 10 described and illustrated herein may attach to a hose of a vacuum cleaner, including a wet/dry vacuum cleaner, and may provide a dirt collection apparatus to grip and remove hair, dust, and debris from a target cleaning area. The shape of the accessory may facilitate suction of the collected dust, hair, and debris. The vacuum accessory 10 may be sized and manufactured to attach to a wide range of vacuum cleaners, from large industrial-sized cleaners to handheld vacuum cleaners.

FIGS. 1-4 illustrate an example of a vacuum accessory 10 shaped to fit in narrow spaces and small crevices and is equipped with a rubber material to facilitate the pick-up of hair, dust, and other debris. The accessory 10 includes a front end 12 defining a fluid inlet 14, a back end 16 defining a fluid outlet 18, and a fluid flow path 19 extending through the accessory 10 and connecting the inlet 14 and the outlet 18. In this example, the accessory 10 includes two main structural components, a head 20 defining the inlet 14 of the accessory 10 and a fitting 22 defining the outlet 18. The head 20 and the fitting 22 meet at a fitting interface 24, and may be integrally formed as a single molded piece or may be separate pieces that are later secured to each other at the fitting interface 24. The fitting 22 is configured to attach to a vacuum hose or other conduit by friction-fit, snap-fit, or other suitable means.

Figure 2:
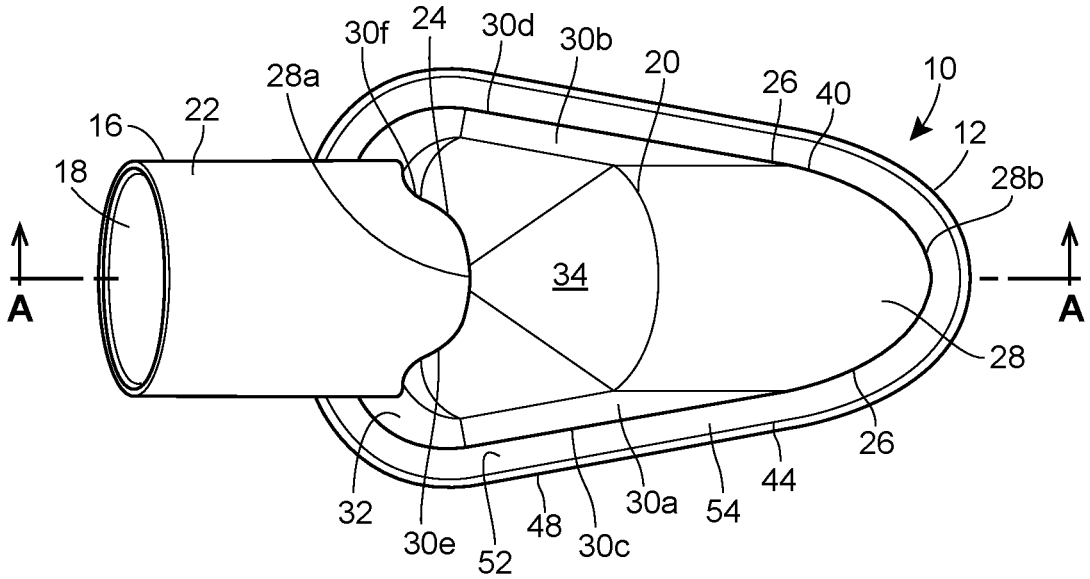
FIG. 2 is a top view of the vacuum accessory of FIG. 1.
Figure 3A:
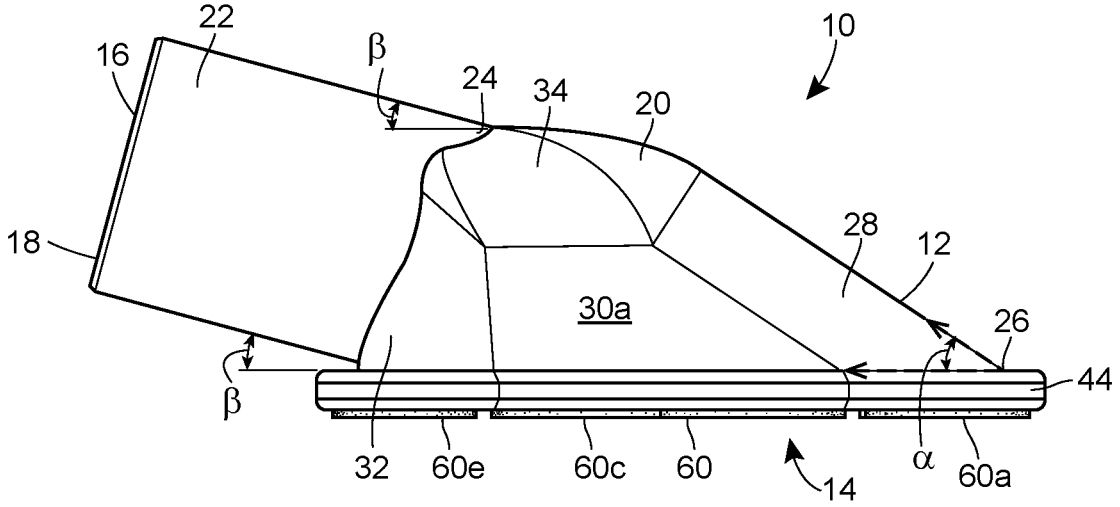
FIG. 3A is a side view of the vacuum accessory of FIG. 1.
Figure 3B:
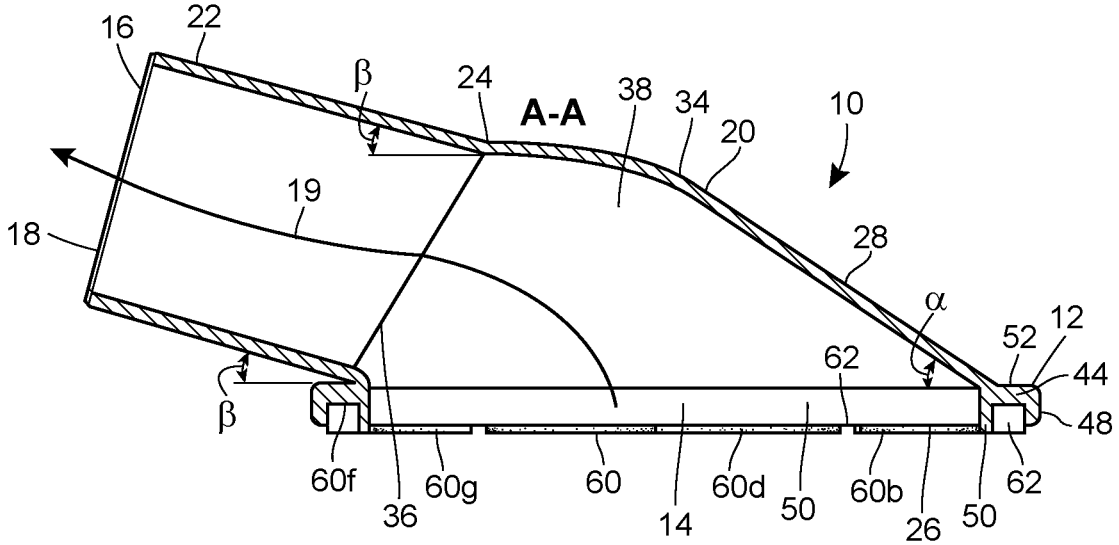
FIG. 3B is a cross-sectional view of the vacuum accessory taken at A-A of FIG. 1.

Shown in FIGS. 1-2, the head 20 forms a cavity and has a particular shape that is well-suited for fitting in hard-to-reach and narrow spaces. The head 20 extends from a base 26 at the inlet 14 to the fitting interface 24 where the fitting 22 meets the head 20. The head 20 includes a plurality of walls 28, 30*a*, 30*b*, and 32, where each wall has a bottom edge 28*b*, 30*c*, 30*d*, and 32*b*, and a top portion 28*a*, 30*e*, 30*f*, and 32*a*, respectively. The bottom edges 28*b*, 30*c*, 30*d*, and 32*b* form the base 26, and the top portions 28*a*, 30*e*, 30*f*, and 32*a* meet at the fitting interface 24. Generally, the head 20 includes a front leading portion 28, first and second symmetrical side portions 30*a* and 30*b*, and a back portion 32. The top portions 28*a*, 30*e*, 30*f*, and 32*a* of the plurality of walls 28, 30*a*, 30*b*, and 32 form a cover portion 34 where the leading 28, side 30*a* and 30*b*, and back 32 portions meet. The leading portion 28, side portions 30*a* and 30*b*, and back portion 32 together form an enclosed area, also referred herein as a cavity 38 of the head 20 as shown in FIG. 3B. The enclosed area 38 is shaped to collect hair, dust, and other debris from a target surface area into the inlet 14 of the head 20, through an interior inlet 36, also referred herein as a fitting inlet, and through the outlet 18 defined by the fitting 22.

Figure 5:
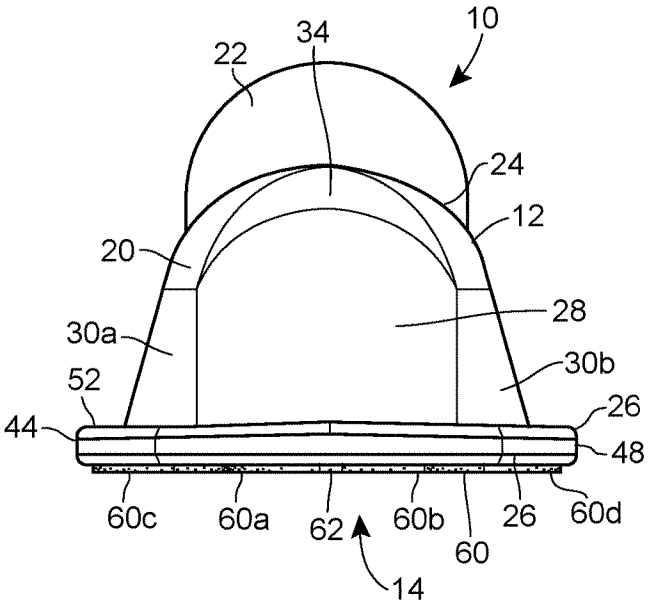
FIG. 5 is a front view of the vacuum accessory of FIG. 1.
Figure 4:
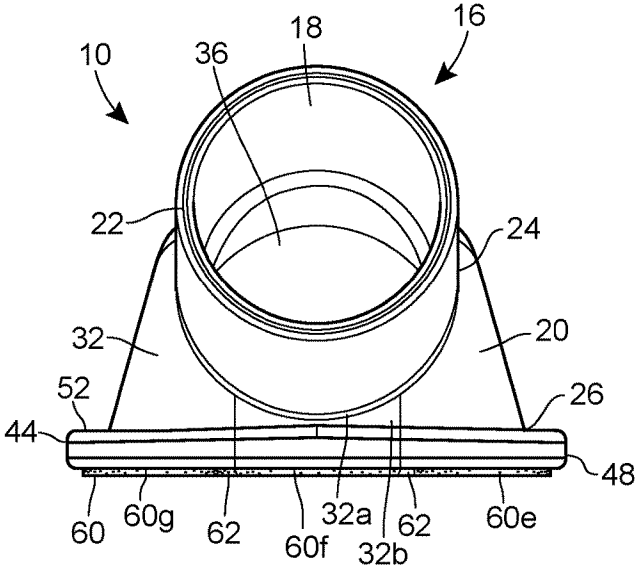
FIG. 4 is a back view of the vacuum accessory of FIG. 1.

Turning back to FIG. 3A, a side view of the accessory 10 illustrates how the head 20 and the fitting 22 are horizontally oriented so that the accessory 10 remains close to the target cleaning surface when used. Specifically at the front end 12 of the accessory 10, the leading portion 28 is oriented at an angle α relative to the base 26. The cover portion 34 flattens slightly relative to the angled front leading portion 28 at a location disposed before the head 20 meets the fitting 22 at the fitting interface 24. The fitting 22 extends from the fitting interface 24 at an angle β relative to the plane of the base 26 that may be the same or less than the angle α of the leading portion 28. In some versions, the angle α can be in a range of approximately 1° to approximately 60°, or preferably, in a range of approximately 10° to approximately 45°; the angle β can be in a range of approximately 1° to approximately 60°, or preferably, in a range of approximately 10° to approximately 45°. The side portions 30*a* and 30*b* extend vertically and slightly angled inwardly toward the cover portion 34, shown in both FIGS. 2 and 3A. As shown in FIGS. 2, 4, and 5, the back portion 32 extends away from the base 26 and along the fitting interface 24, and at least partially defines the interior inlet 36.

Figure 6:
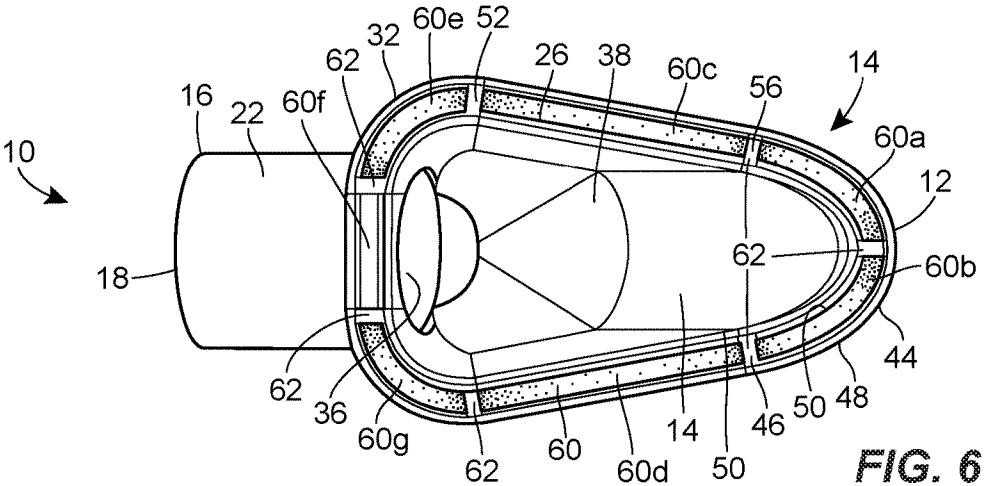
FIG. 6 is a bottom view of the vacuum accessory of FIG. 1.

As shown in FIG. 2, the base 26 has a rounded triangular-shaped perimeter 40 and a lip 44 that extends outwardly from the perimeter 40 of the base 26. The lip 44 includes a groove or channel 46, which may be a U-shaped channel, as shown in FIG. 6, that extends around the perimeter 40 of the base 26. The channel 46 illustrated in FIGS. 3B and 6 includes an exterior barrier wall 48, an interior barrier wall 50, and a bridge 52 connecting the exterior 48 and interior 50 barrier walls. The bridge 52 includes an exterior surface 54, shown in FIG. 2, and an interior surface 56, shown in FIG. 6. So configured, the U-shaped channel 46 has an open end disposed downwardly relative to the head 20 such that the interior side 56 of the bridge 52 is adapted to receive a plurality of segmented pads 60 that are attached or otherwise secured to the groove or channel 46 of the lip 44. In other examples, the lip 44 may provide a plurality of grooves to receive a plurality of hair-attracting pads.

As shown in FIGS. 3A-6, each of the plurality of pads 60 extends beyond the barrier walls 48, 50 of the channel 46 to reach a target surface area. Each of the plurality of pads 60 is made of an elastomer or other material having suitable material properties to permit hair collection and removal. In one example, the pads 60 are made of a natural gum rubber having suitable insulation properties to generate static charge to attract and collect hair, dust, and debris when the pads 60 contact the target surface area. Natural gum rubber provides suitable surface friction or stickiness, which permits the pads 60 to grip hair, dust, and other debris when in contact with the pads 60. Another benefit of natural gum rubber pads 60 includes good abrasion resistance, permitting the pads 60 to withstand constant contact and rubbing against an abrasive surface, like carpet, without rapidly deteriorating. Natural gum rubber has a high tensile strength compared to other elastomers, such as neoprene, permitting the gum rubber to stretch without snapping. In use, the natural rubber pads 60 may deform and increase in surface area to reach and collect hair, debris, and dust while the accessory 10 is swept across the cleaning surface. In case the material ruptures or wears out, the pads 60 may stay in-tact due to the high tear resistance of natural gum rubber. The tear resistance property is particularly useful for the accessory 10 to clean hard-to-reach places because if a pad 60 were to rupture, the pad 60 would not break off from the lip 44 of the accessory 10 and add to the debris in those hard-to-reach cleaning areas. The slight extension of the pads 60 beyond the barrier walls 48 and 50 of the channel 46 does not inhibit movement of the accessory 10 against a cleaning surface, obstruct a suction flow path, or adversely affect other functionalities of the accessory 10.

The material of the pads 60 of the accessory 10 is not limited to natural gum rubber, and other examples of the accessory 10 may include pads 60 made of other elastomers (e.g. latex), gels, woven fibers, non-woven fibers, or other suitable materials. A suitable material for the pad 60 may provide material properties that would allow the pads 60 to attract and grip hair, dust, and debris and then release the collected material when a suction force is applied via the fluid flow path 19. In some examples, the ability of the material to generate electrostatic force by the sweeping motion and a coefficient of surface friction preferably fall within certain ranges that permit the pads 60 to remove hair from the target cleaning area and release the removed hair when a suction force is applied.

Turning to the illustrated example of FIG. 6, the pads 60 are segmented such that there are first and second leading portion pads 60*a* and 60*b*, first and second side portion pads 60*c* and 60*d*, and first, second, and third back portion pads 60*e*, 60*f*, and 60*g*. The pads 60 may be attached to the interior surface 56 of the bridge 52 of the channel 46 by adhesive or another suitable mechanism that permits easy attachment and removal when desired. In case the leading pads 60*a* and 60*b* are subject to more wear than the other pads 60, the first and second leading portion pads 60*a* and 60*b* may be removed and replaced without removing and replacing the remaining side and back pads 60. A plurality of spaces 62 are disposed between the pads 60 such that the pads 60 are segmented, rather than forming an enclosed loop. The dividing spaces 62 limit instances where the vacuum pressure could cause the pads 60 to seal with the cleaning surface and limit the cleaning operation of the accessory 10. So configured, the dividing spaces 62 in the channel 46 and between the pads 60 permit air circulation during use such that the accessory 10 does not seal off the vacuum hose. The dividing spaces 62 between the segmented pads 60 also permit a user to easily remove a particular pad 60 when desired. In other examples, the head 20 may include more or fewer pads 60 and wider or more narrow dividing spaces 62.

In one example, the lip 44 may be integrally formed with the base 26 of the head 20. In another example, the lip 44 may be a rounded triangular shaped ring formed separately from the base 26 of the head 20 and configured to be removably attached to the base 26. For example, the lip 44 may slip over the fitting 22 and the body of the head 20 to tightly secure to the base 26. In this case, the perimeter 40 of the base 26 would be wider than an interior perimeter of the lip 44 such that the lip 44 would attach to the head 20 by a friction fit or a press-fit. The lip 44 and/or the pads 60 may be disposable as a cartridge and easily replaced with another lip cartridge.

The shape of the accessory 10 may be optimized for interior cleaning of vehicles. The low-angled head 20 allows a user to reach into narrow areas with ease. The low angle permits the accessory 10 and hose of the vacuum cleaner to stay in close proximity of the surface being cleaned. In this way, the accessory 10 or attached hose can slide under tight spaces under seats, floor mats, and dashboards without difficulty and without causing the movement of the fitting 22 and/or head 20 of the accessory 10 to be obstructed. The low orientation of the head 20 and the fitting 22 of the accessory 10 also provide the accessory with greater suctioning effective area because the illustrated configuration does not require the user to lift or rotate the accessory 10 away from the target area to reach target areas.

The accessory 10 illustrated here has a particular ornamental arrangement for the head 20. While the illustrated arrangement provides all the functional benefits described here, some of the details of this particular arrangement may add to the cost of manufacture. Consequently, the illustrated accessory may not provide all of the possible economic advantages that might be derived from the invention. On the other hand, this particular arrangement is believed to be aesthetically pleasing and is likely to be recognized and relied upon by purchasers to identify the source of the vacuum accessory.

Figure 7:
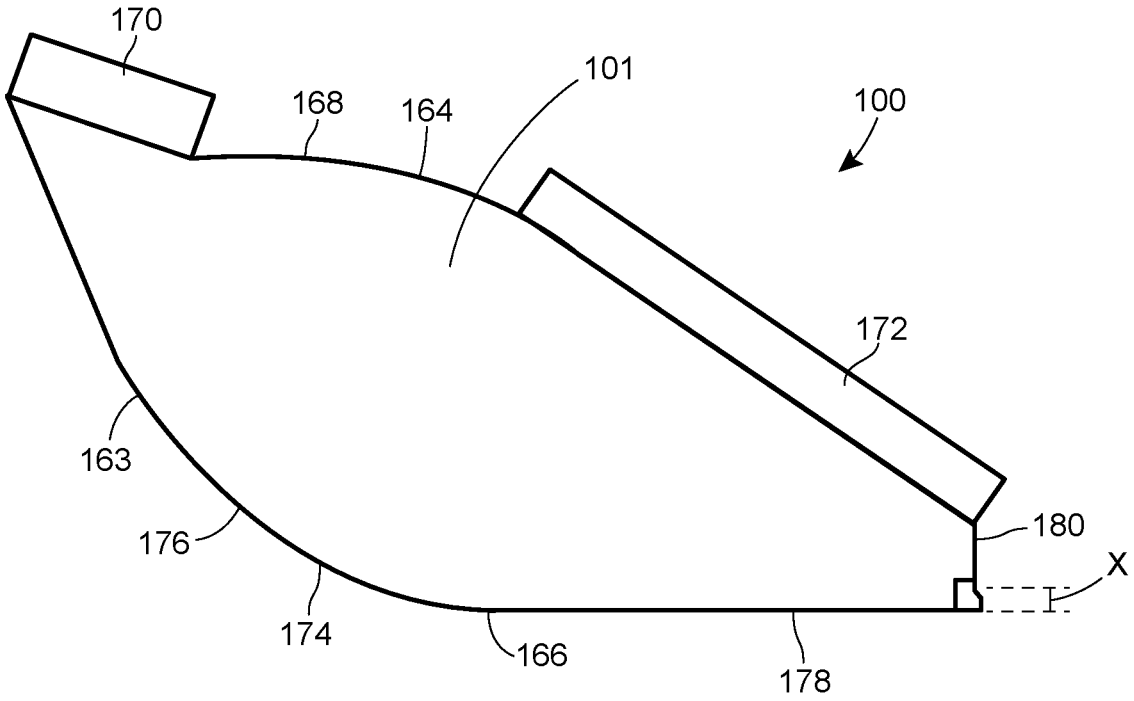
FIG. 7 is a side view of a first exemplary blade for use with a vacuum accessory such as the vacuum accessory of FIG. 1.

In FIG. 7, a removable blade 100 is constructed according to the teachings of the present disclosure, and is adapted for use with the accessory 10 illustrated and described above. In FIGS. 8-11, a second exemplary vacuum accessory 110 is constructed in accordance with the teachings of the present disclosure. The accessory 110 is similar to the accessory 10 described above, except that the accessory 110 is coupled to a blade 100 and includes a slight variation in pad arrangement. Elements of the accessory 110 in FIGS. 7-11 which are similar to the elements of the accessory 10 are designated by the same reference numerals, incremented by 100. A description of many of these elements is abbreviated or even eliminated in the interest of brevity.

The blade 100 includes a blade body 101 that is defined by a top edge 168 and a bottom edge 174, where the top edge 168 is contoured to match an interior curvature of a leading portion 128 of a head 120 of the accessory 110 and the bottom edge 174 is positioned slightly beyond a lip 144 at a base 126 of the head 120. The blade 100 includes curved perimeter 163 with a top portion 164 shaped to be positioned adjacent to an interior surface 133 of the head 120 of the accessory 110 and a bottom portion 166 is positioned within a cavity 138 of the head 120 to divide the cavity 138 and extend past the base 126 of the accessory 110. The top portion 164 of the blade 100 includes a top edge 168 and protruding first and second tabs 170 and 172 extending from the top edge 168 at two different places. The first and second tabs 170 and 172 are configured to removably attach the blade 100 to the head 120 of the accessory 110. The top edge 168 of the blade 100 may be shaped so that the edge 168 mates with the interior surface 133 of the cover portion 134, the leading portion 128, and down to the base 126 of the head 120. The top edge 168 may be lined with a rubber material to facilitate a sealing engagement between the interior surface 133 of the head 120 and the blade 100. The bottom portion 166 includes the bottom edge 174 that defines a curved portion 176 and an extended portion 178 of the blade 100. Specifically, the bottom edge 174 slopes downward relative to the top edge 168 of the blade 100 until the bottom edge 174 plateaus so that the edge of the extended portion 178 is generally parallel with a target surface. A leading edge 181 connects the top edge 168 and the extended portion 178 of the blade 100. The figures illustrate one example of the blade 100 coupled to the vacuum accessory 110, but the blade 100 may be customized to provide a different shape, extending portion, and/or material based on the accessory and cleaning surface needs. The blade 100 may be used alone or in combination with the gripping pads of the lip 144 of the accessory 110.

Figure 8:
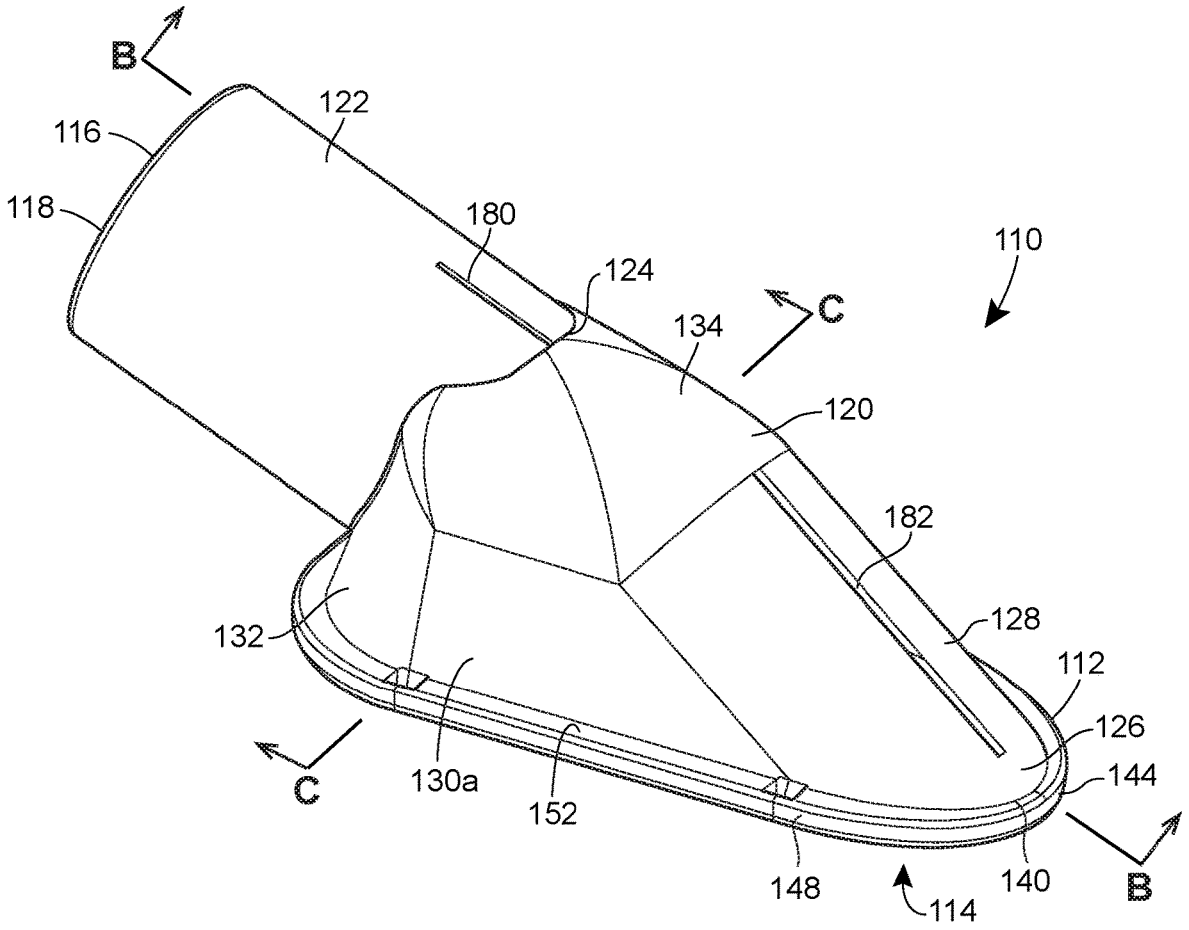
FIG. 8 is a perspective view of a second exemplary vacuum accessory constructed in accordance with the principles of the present disclosure.
Figure 9:
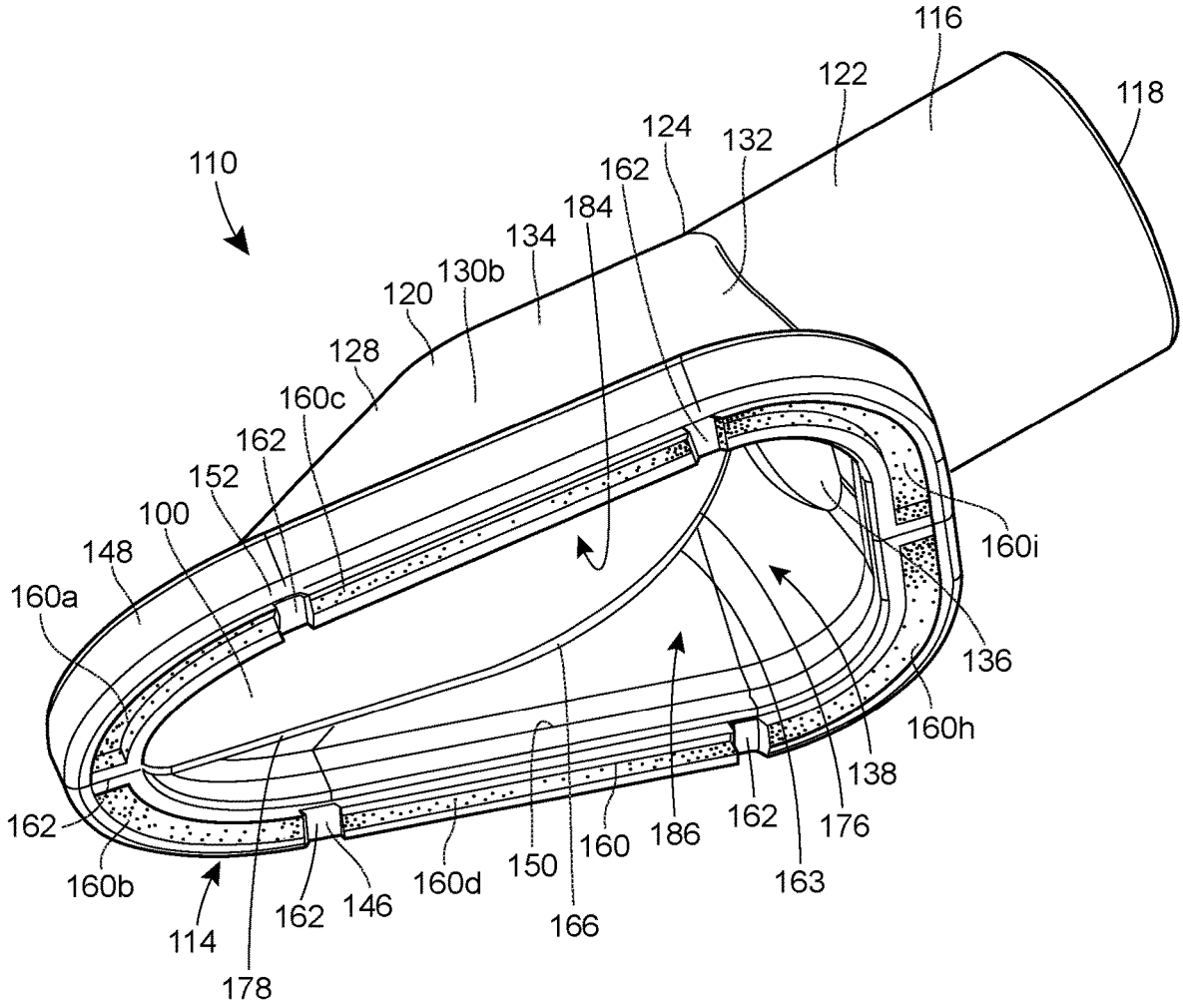
FIG. 9 is perspective view of the interior of the vacuum accessory of FIG. 8 with the first exemplary blade of FIG. 7.

The blade 100 is removably coupled to the head 120 to facilitate exchanging different blades for different cleaning purposes or to be completely removed from the accessory 110 if so desired. As shown in FIG. 8, the accessory 110 includes a first mounting slot 180 formed in the fitting 122 and a second mounting slot 182 formed in the leading portion 128 of the head 120. The first and second mounting slots 180 and 182, also referred herein as first and second slots, are sized to receive first and second tabs 170 and 172, respectively. The tabs 170 and 172 may secure to the head 120 by a friction fit or by other locking means. As shown in FIG. 9, when the tabs 170 and 172 are secured to the head 120 and are disposed in the slots 180 and 182, the blade 100 partially divides the cavity 138 of the head 120 into a first compartment 184 and a second compartment 186. The blade 100 is oriented perpendicular relative to a target surface area, but in other configurations, the blade 100 may be disposed at an angle relative to the axis of the head 120. The first and second tabs 170 and 172 and first and second slots 180 and 182 may be configured in any suitable female-male configuration to removably couple the blade 100 and the accessory 100 by a snap-fit, press-it, or lock-and-key engagement. The blade 100 may have one tab or more than two tabs, and the accessory 110 may have one slot or more than two slots, accordingly. Additionally, the tabs 170, 172 may couple to just the head 120 or may couple to both the head 120 and the fitting 122.

Figure 10:
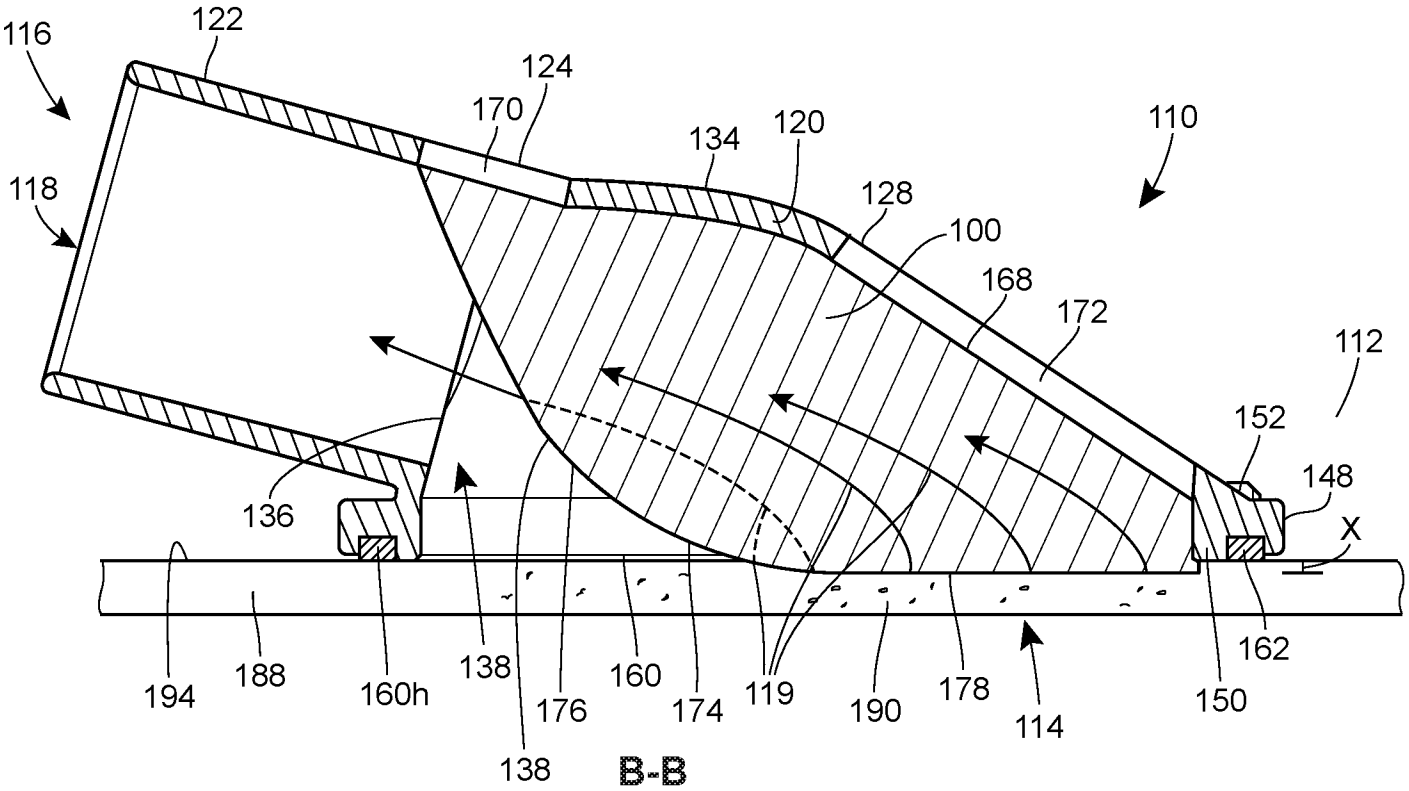
FIG. 10 is a cross-sectional view of the vacuum accessory and blade taken at B-B of FIG. 8 when the vacuum accessory is in use.

The blade 100 at least partially divides a portion of the fluid flow path 119. As shown in FIG. 10, the top edge 168 of blade 100 may completely seal with the interior surface 133 of the head 120. The shape of the blade 100 may generally follow the cross-section of the head 120 of the accessory 110, extending beyond the base 126 of the accessory 110, and with the curved back portion 176 stopping short of dividing the entire cavity 138 and an interior inlet 136 of the accessory 110. The extended portion 178 is sized to protrude a distance X from the lip 144 of the base 126 when the blade 100 is attached to the head 120 of the accessory 110. In one example, the blade 100 may extend approximately 0.025 to 0.125 inches beyond a horizontal plane of the base 126. The curved portion 176 of the blade 100 is partially disposed within the interior inlet 136 of the fitting 122 and partially disposed away and in front of the interior inlet 136 of the fitting 122. In this way, the blade 100 partially divides the inlet 136 of the fitting 122. In another example, the top edge 168 may not seal with the interior surface 133 of the head 120.

Figure 11:
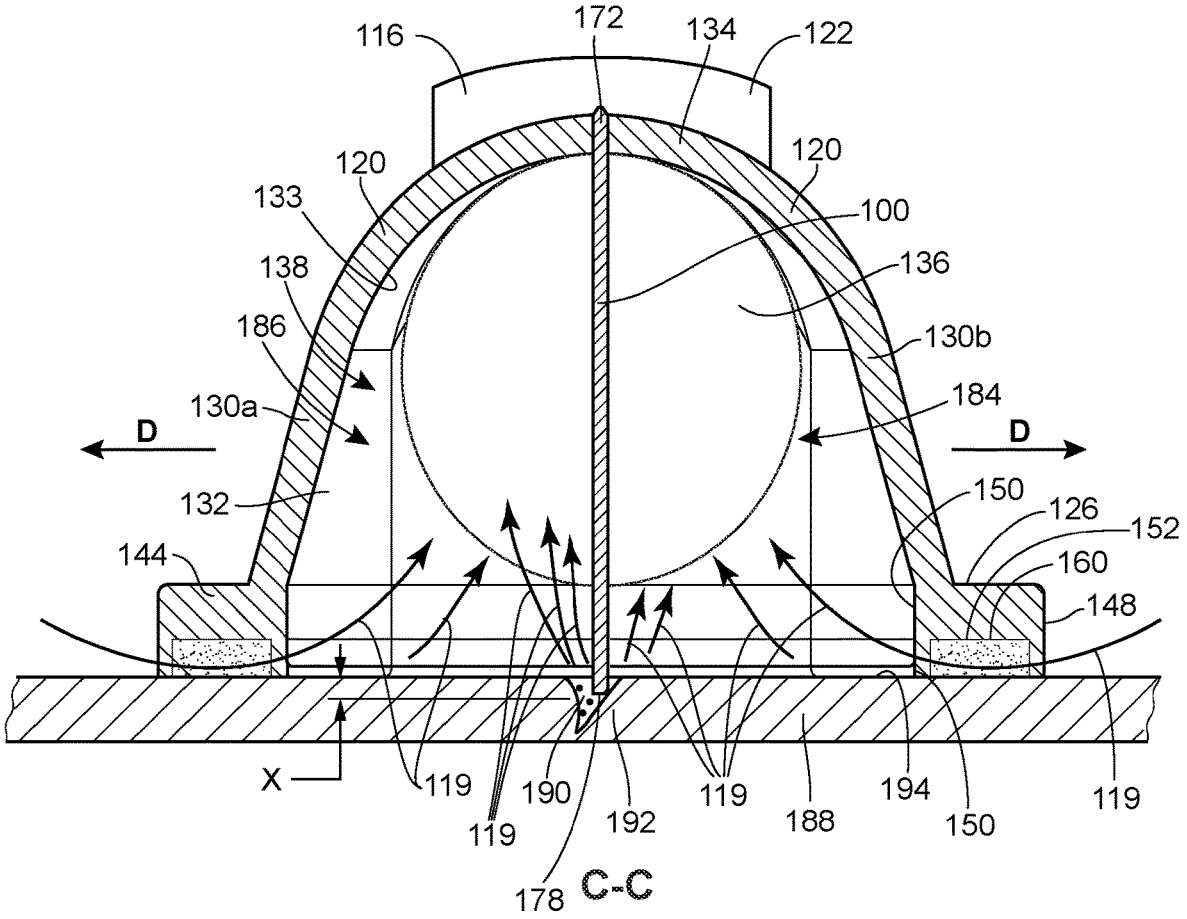
FIG. 11 is a front cross-sectional view of the vacuum accessory and blade taken at C-C of FIG. 10.

FIGS. 10 and 11 illustrate the accessory 110 interacting with a target surface cleaning area 188, such as a rug or carpet, to pick up dust and debris 190. Multiple fluid flow paths 119 extend through the accessory 110 from an inlet 114 defined by the head 120 and an outlet 118 defined by the fitting 122. The blade 100 of the accessory 110 may divide the fluid flow path 119 when the accessory is used with a vacuum and a suction force is applied as illustrated by the different fluid flow paths 119. The extended portion 178 of the blade 100 to extends through a top layer 194 of the target cleaning surface 188, and is inserted into and between fibers 192 of a carpet or a rug 188. The blade 100 pushes between individual carpet fibers 192 causing the fibers 192 to move to either side of the blade 100. By separating the fibers 192, the accessory 110 can reach deeper into fibrous cleaning surface areas 188, allowing the force of suction to access dirt and other debris 190 disposed beyond the top surface 194 of the cleaning area 188. The blade 100 is also configured to dislodge hardened dirt caked in the fibers 192 of the carpet 188. As the accessory 110 is moved side to side in direction D in FIG. 11, the blade 100 breaks up hardened mud and other debris 190 into pieces and separates the debris 190 from the fibers 192 so that the suction force may collect the debris 190 that was otherwise fastened to the target cleaning surface 188. The blade 100 may also provide a scraping function for use on smooth or non-carpeted target cleaning surfaces. The blade 100 may be made of a rigid rubber or plastic material or other suitable material that does not deform when pressure is applied to the blade 100.

Figure 12:
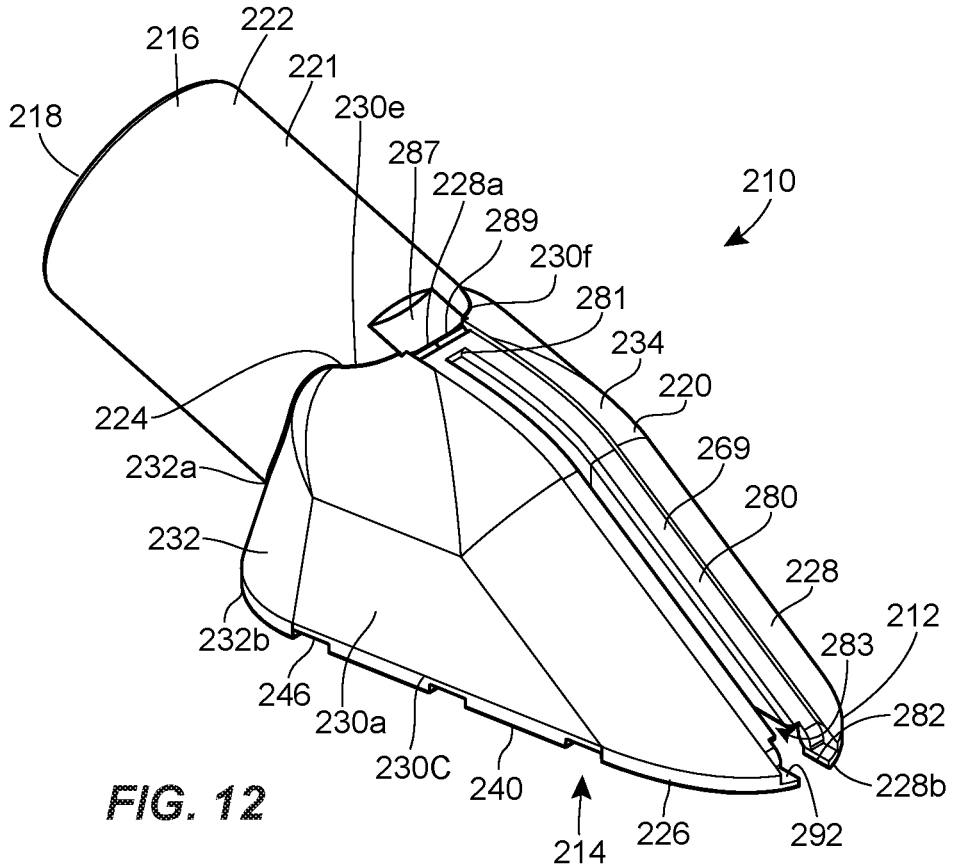
FIG. 12 is perspective view of a third exemplary vacuum accessory constructed in accordance with the principles of the present disclosure.
Figure 13:
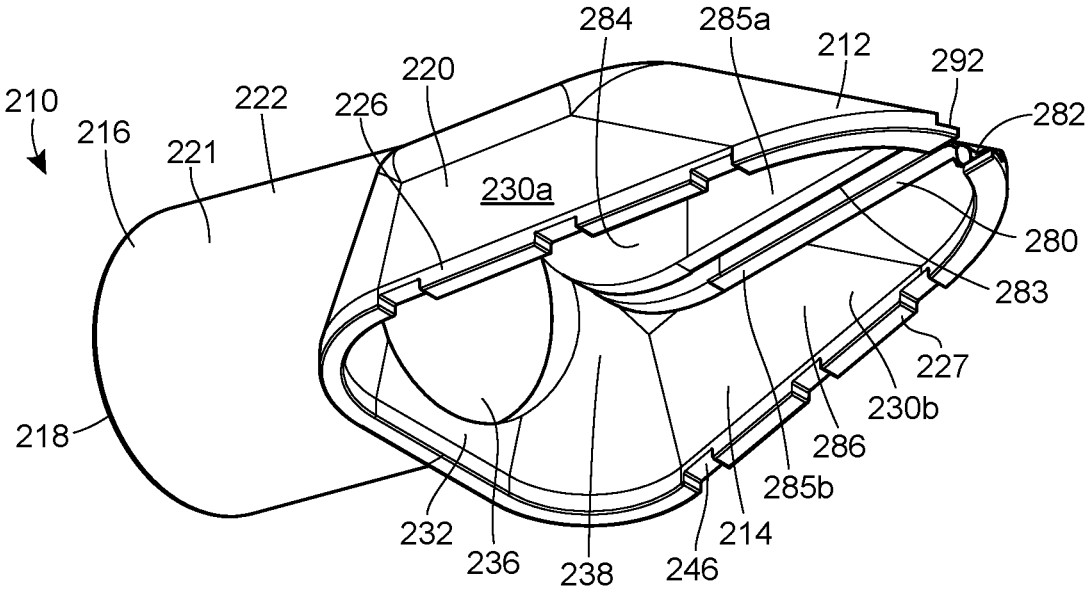
FIG. 13 is an interior perspective view of the vacuum accessory of FIG. 12.

In FIGS. 12 and 13, a third exemplary vacuum accessory 210 is constructed in accordance with the teachings of the present disclosure. The accessory 210 is similar to the accessories 10 and 110 described above, except that the accessory 210 provides a different coupling mechanism for coupling multiple blades, such as blades 200, 300, and 400 illustrated in FIGS. 14A-C, 18A-C, 22A-C, respectively. The blades 200, 300, and 400 may be used for different cleaning purposes, for example, the second exemplary blade 200 may be used to break up hardened dirt, the third exemplary blade 300 may be used to attract hair and dust, and the fourth exemplary blade 400 may be used for cleaning fragile and delicate surfaces. Further, each of the blades 200, 300, and 400 is coupled to the vacuum accessory 210 by a different mechanism than illustrated and described herein with respect to the accessories 10 and 110. Elements of the accessory 210 in FIGS. 12-25B which are similar to the elements of the accessories 10 and 110 are designated by the same reference numerals, incremented by 200 and 100, respectively. A description of many of these elements is abbreviated or even eliminated in the interest of brevity.

Similar to the accessories 10 and 110 described above, a head 220 of the accessory 210 includes a plurality of walls 228, 230*a*, 230*b*, and 232 that form a cavity, also referred herein as an enclosed area 228. Each of the plurality of walls 228, 230*a*, 230*b*, and 232 has a top portion 228*a*, 230*e*, 230*f*, and 232*a*, which meet at the fitting 222 to form a fitting interface 224. Each of the plurality of walls 228, 230*a*, 230*b*, and 232 also has a bottom edge 228*b*, 230*c*, 230*d*, and 232*b*, which together form a base 226. The plurality of walls 228, 230*a*, 230*b*, and 232 include a front leading portion 228, first and second symmetrical side portions 230*a* and 230*b*, and a back portion 232. Put differently, the head body 220 defines an inlet 214 and the fitting interface 224 where the head body 220 extends from the fitting interface 224 to a base 226 and encloses the cavity 228. The fitting 222 is connected to the head 220 at the fitting interface 224 and includes a fitting body 221 symmetrically formed about a longitudinal axis J. In the illustrated example, the fitting 222 has a cylindrical body 221 which defines a fitting inlet 236, an outlet 218, and a flow path 217 connecting the fitting inlet 236 and the outlet 218. The base 226 has a bottom surface 227 and a plurality of notches 246 formed in the bottom surface 227 to facilitate air flow during use. The bottom surface 227 of the base 226 lies on a horizontal plane that is configured to be parallel to a flat cleaning surface. The accessory 210 differs from the accessories 10 and 110 by including a blade track 280 formed in the leading and cover portions 228, 234 of the head body 220. The top portion 228*a* of the leading portion 228 provides an engaging member (or bridge portion) 289 for coupling the accessory 210 to a blade 200; and the bottom edge 228*b* of the leading portion 228 provides a shoulder portion 289 that mates with a top portion 264 of the blade 200.

As illustrated in FIGS. 12 and 13, the accessory 210 includes the blade track 280 that is aligned with a longitudinal axis J of the fitting 222 such that a plane can pass through the track 280 and contain the axis J. This plane is referred herein as a reference plane, and is used to describe the relative placement of the fitting 222, the head 220, and the orientation of the blade 200. The track 280 includes a first end 281, a second end 282, and a slot 283 between the first end 281 and the second end 282. The blade track 280 is further defined by first and second parallel partitions 285*a* and 285*b* that help guide and align the blade 200 when the blade 200 is attached to or removed from the accessory 210. A receiving aperture 287 formed in the head 220 and/or fitting 222 is located between the outlet 218 of the fitting 222 and the first end 281 of the track 280. The receiving aperture 287 is an opening partially defined by the bridge portion 289, which is perpendicularly situated relative to the direction of the slot 283. As described further below, the track 280 is partially recessed and sized to receive a flanged top edge 268 of the blade 200. The slot 283, which is aligned with the J axis, is sized to receive a width W of the blade body 201. The receiving aperture 287 is sized to receive a fastening member 272 of the blade 200 and may extend into the fitting 222 to accommodate a user's finger to lift a portion of the fastening member 272 to decouple the blade 200 from the head 220.

Figure 14A:
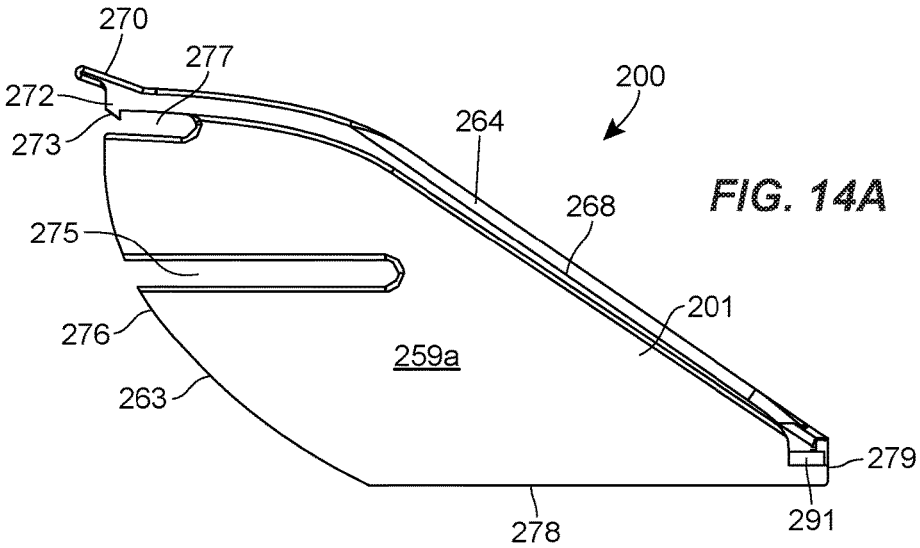
FIG. 14A is a side view of a second exemplary blade for use with the vacuum accessory of FIG. 12.
Figure 14B:
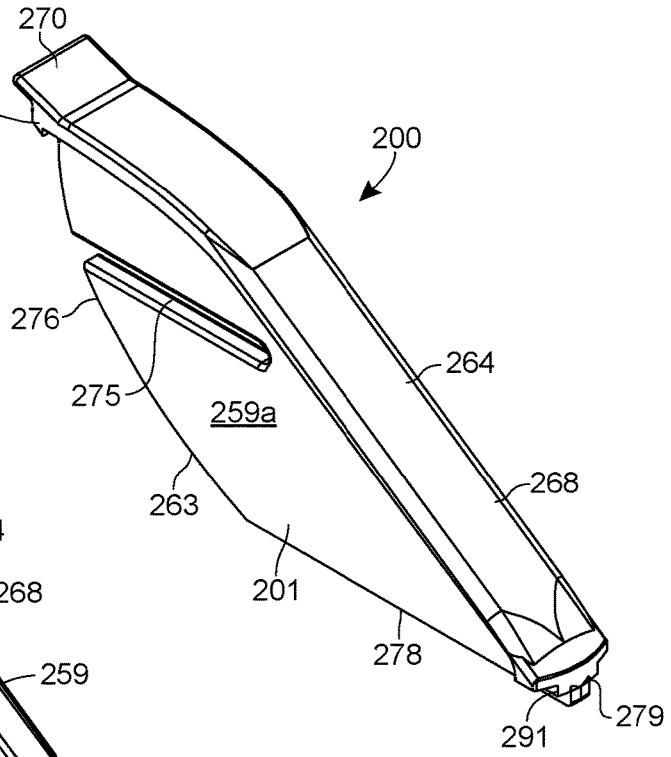
FIG. 14B is a front perspective view of the second exemplary blade of FIG. 14A.
Figure 14C:
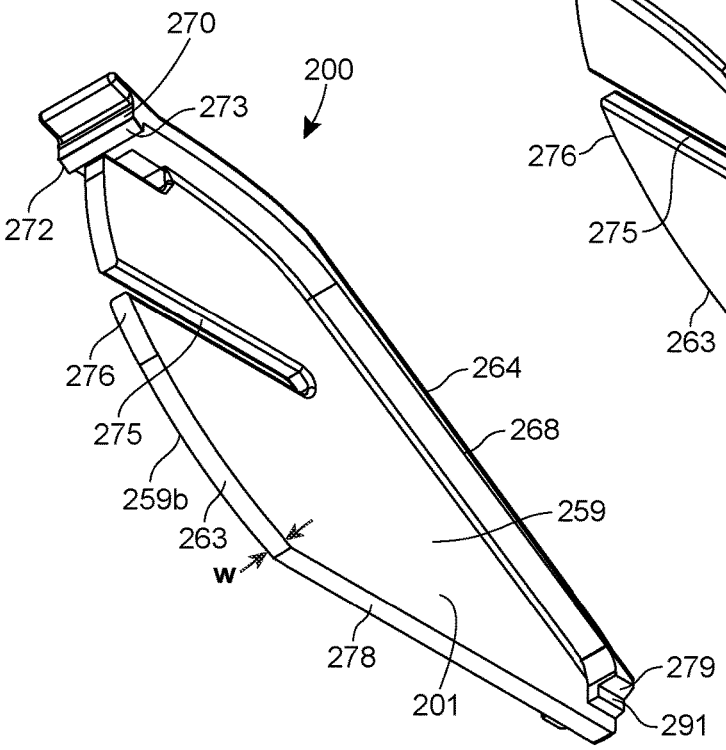
FIG. 14C is a back perspective view of the second exemplary blade of FIG. 14A.
Figure 15:
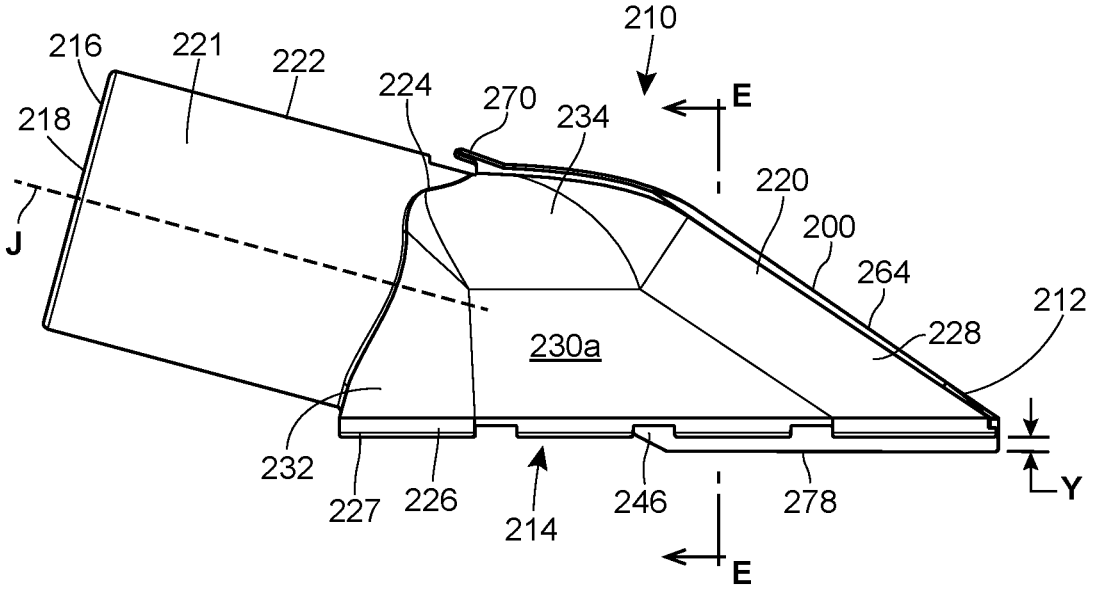
FIG. 15 is a side view of the second exemplary blade of FIGS. 14A-C attached to the third exemplary vacuum accessory of FIG. 12.
Figure 16:
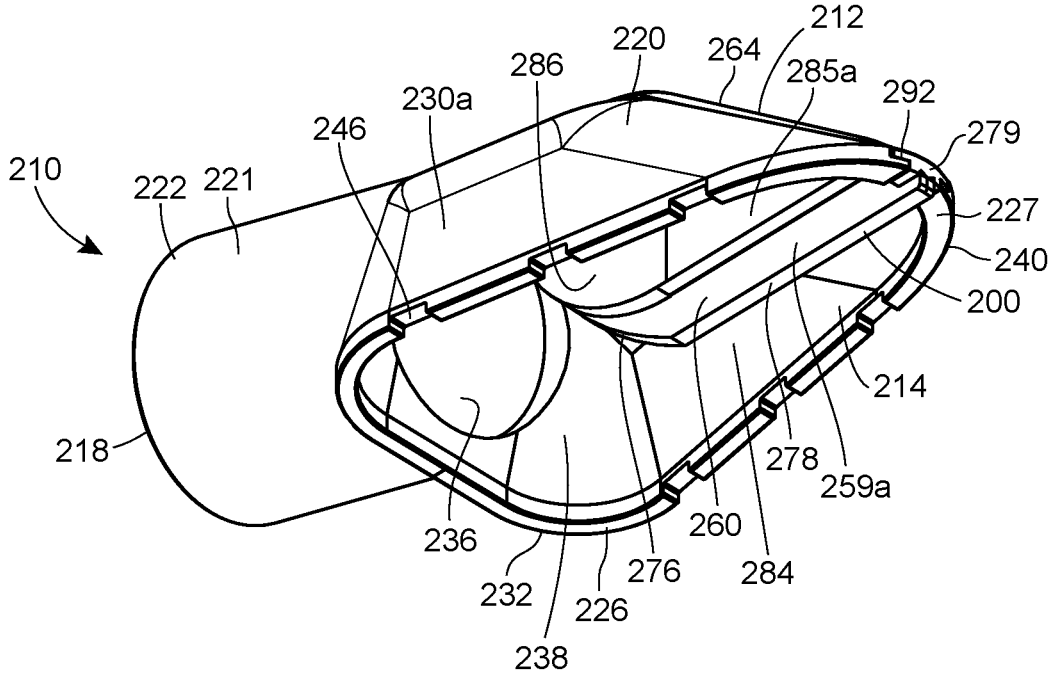
FIG. 16 is an interior perspective view of the blade attached to the vacuum accessory of FIG. 15.

In FIGS. 14A-25B, second 200, third 300, and fourth 400 exemplary blades are illustrated alone and also coupled to the accessory 210 of FIGS. 12 and 13. Turning first to FIGS. 14A-14C, the second exemplary blade 200 includes a blade body 201 having a top portion 264, a leading edge 279, a bottom edge 278, and a back edge 276. The blade 200 is sized and positioned to divide the cavity or enclosed area 238 of the head 220 into compartments 284 and 286. The blade body 201 has first and second parallel sides 259*a* and 259*b* separated by width W. The body 201 is sized to slide within the slot 283 and between the partitions 285*a* and 285*b* of the track 280. When the blade body 201 is disposed in the slot 283 of the track 280, a portion of the first side 259*a* of the body 201 faces an interior surface of the first partition 285*a*, and a portion of the second side 259*b* of the body 201 faces an interior surface of the second partition 285*b*. The top portion 264 includes a sloped profile that generally follows the outer curvature of the leading portion 228 of the head 220 from a first end 270 to a leading edge 279. The top portion 264 includes a flanged top edge 268 with symmetrical flanges that extend outwardly from the first and second sides 259*a* and 259*b* of the blade body 201. The track 280 is recessed relative to the outer surface of the head 220 on both sides of the slot 283 to at least partially receive the flanged top edge 268 of the blade body 201. As shown in FIGS. 15 and 16, the flanged top edge 268 runs parallel to the curvature of the leading portion 228 of the head 220, and is shaped to mate with an outer surface 269 of the track 280. The flanged top edge 268 serves to guide the blade 200 through the track 280 and to keep the blade 200 from falling through the slot 283.

Figure 17A:
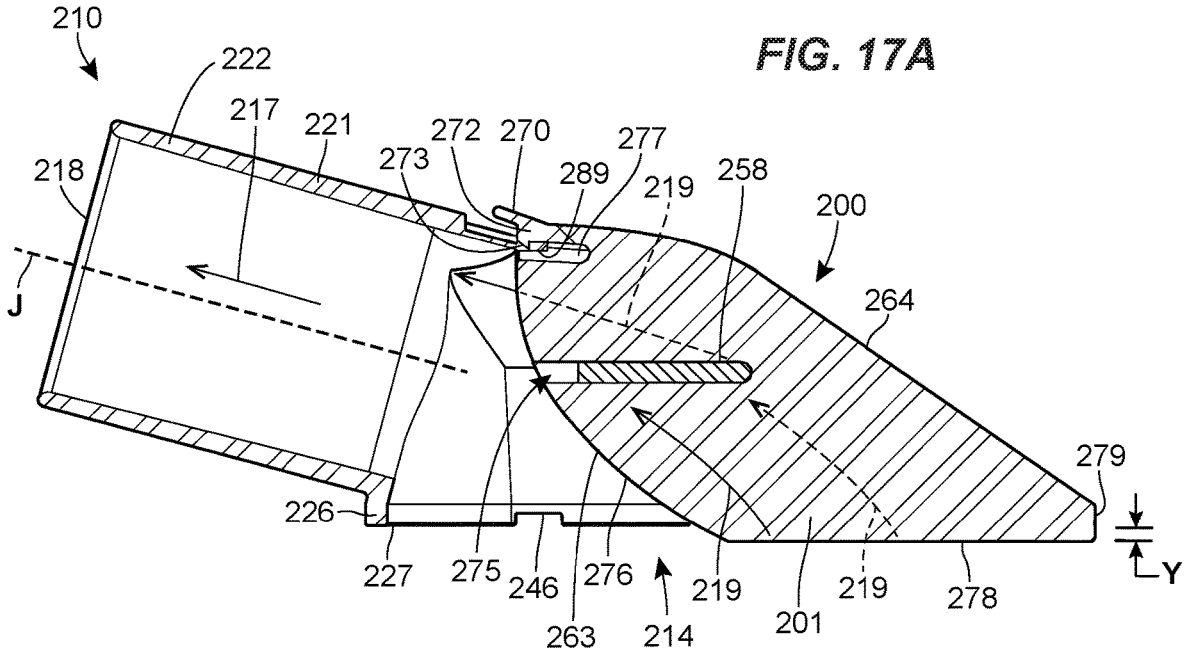
FIG. 17A is a cross-sectional view of the vacuum accessory and blade of FIG. 15.
Figure 17B:
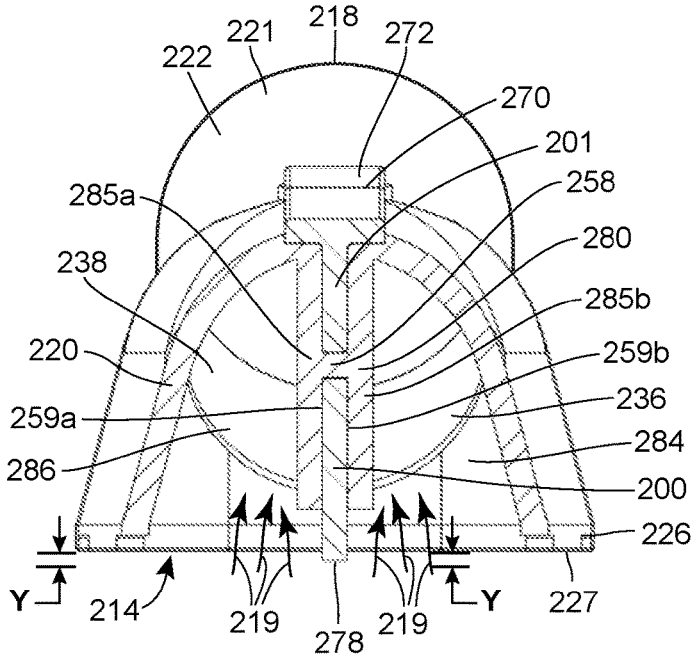
FIG. 17B is a cross-sectional view of the vacuum accessory and blade taken at E-E of FIG. 15.

As shown in FIGS. 14A-C and 17A, the first end 270 of the top portion 264 includes a tab extending in a direction beyond the back edge 276 of the blade 200 and a fastening member 272 positioned below the flanged top edge 268. The fastening member 272 has an angled end 273 that engages with the bridge portion 289 of the accessory 210 when the blade 200 is coupled the first end 270 to the accessory 210, as shown in FIG. 17A. The angled end 273 extends downward from the top portion 264 of the blade 200 and is adapted to be disposed in the receiving aperture 287 of the accessory 210 when the fastening member 272 is coupled to the accessory 210. The bridge portion 289 is a portion of the track 280 disposed at the first end 281 of the slot 283, separating the slot 283 from the receiving aperture 287. To couple the blade 200 to the accessory 210, the back edge 276 of the blade 200 enters the slot 283 at the second end 282 of the track 280 and slides through the track 280 until the first end 270 of the top portion 264 meets the first end 281 of the slot 283. The end 273 of the fastening member 272 is angled to slide against the bridge portion 289, causing the fastening member 272 to deform by expanding outwardly relative to the back edge 276 of the blade 200. The fastening member 272 flexes outwardly until the end 273 is received by the aperture 287 and then the fastening member 272 returns to its original, relaxed configuration so that the end 273 may engage with a trailing edge of the bridge portion 289. The blade 200 may be removed from the accessory 210 by lifting the tabbed first end 270 and again flexing the fastening member 272 outwardly away from the receiving aperture 287 to disengage the angled end 273 from the bridge portion 289. The top portion 264 of the blade 200 may be a material with a suitable flexibility to permit deformation of the fastening member 272 without permanently deforming or breaking the fastening member 272 from the blade 200. In the illustrated example, the fastening member 272 is a deformable tab which can deform to bend away from the back edge 276 of the blade 200 to facilitate attachment to, and removal from, the receiving aperture 287. In other examples, the fastening member 272 may be a hook, a clasp, or other suitable member that is functionally equivalent, As shown in FIGS. 14A-C, the back edge 276 is curved so that the back edge 276 may be entirely disposed within the cavity 238 of the head 220 and positioned adjacent to the fitting inlet 236. A curved perimeter 263 connects the first end 270 of the top portion 264 and the bottom edge 276 of the blade 200 in a gradual or steep slope. The curved perimeter 263 of the blade body 201 is steep, smooth, and without sharp edges of the blade 200 disposed near the fitting inlet 236 and within the cavity 238. The smooth edges of the blade 200 may substantially reduce or limit instances that hair, dirt, and other debris get caught on or wrapping around the blade 200, leading to airflow blockage of the accessory 210. The curved perimeter 263 of the back edge 276 includes a first slot 275 and a second slot 277, both extending from the back edge 276 and into the blade body 201. The first slot 275 is positioned to correspond with the location of a guiding flange 258 (as shown in FIGS. 17A and 17B) of the track 280 and is sized to receive the guiding flange 258 when the blade 200 is attached to the accessory 210. The first slot 275 may be substantially parallel to the bottom edge 278 of the blade 200. The second slot 277 is disposed adjacent to the fastening member 272 and receives the bridge portion 289 of the accessory 210 when the blade 200 is coupled to the accessory 210. The second slot 277 partially defines the fastening member 272 such that when the fastening member 272 is lifted away from the back edge 276, the second slot 277 opens wider so that the blade 200 may slide in or out of engagement with the track 280. The sizes of the slots 275 and 277 may vary depending on the placement and size of the guiding flange 258 and the aperture 287, respectively, of the accessory 210. In other examples, the slots 275 and 272 may be arranged differently to securely couple the blade 200 to the accessory 210.

The blade 200 and the accessory 210 are constructed in accordance to the present disclosure to facilitate attaching and removing the blade 200 to the accessory 210 with ease. In FIGS. 15-17B, the blade 200 couples to the head 220 of the accessory 210. The bottom edge 278 of the blade 200 is sized to extend slightly beyond the bottom surface 227 of the base 226 of the head 220 when the blade 200 is attached to the accessory 210. The leading edge 279 of the blade body 201 has a stepped cross-section and is defined by a leading portion of the bottom edge 278 and the flanged top edge 268. The stepped cross-section of the leading edge 279 sits flush against the second end 282 of the track 280 when the blade 200 is coupled to the accessory 210. The leading edge 279 includes tabs 291 extending downward from the flanged portion 268 to grip a portion of the blade 200 disposed above the bottom edge 278. The tabs 291 partially form the stepped cross-section and are configured to mate with the shoulder portion 292 formed in the second end 282 of the track 280. The shoulder portion 292 is a recessed groove symmetrical about the slot 283 and disposed at the front end 212 of the accessory 210. In other examples, the leading edge 279 of the blade body 201 engages the track 280 by other suitable configurations.

In FIGS. 15, 16, 17A, and 17B, the blade 200 is disposed within the slot 283 of the head 220 of the accessory 210. The leading edge 279 sealingly mates with the shoulder portion 292 of the track 280 so that the leading edge 279 is flush with the second end 282. Between the leading edge 279 and the first end 270, the flanged top edge 268 is disposed within the track 280 and sealingly mates with the outer surface 269 of the track 280. The end 273 of the fastening member 272 is disposed within the receiving aperture 287 and engaged with the edge of the bridge portion 289, securing the blade 200 to the accessory 210. The base 226 and the curved back edge 276 stops short of dividing the entire enclosed area 238 and the interior inlet 236 of the accessory 210. The bottom edge 278 extends beyond the bottom surface 227 a distance Y beyond the bottom surface 227 of the base 226. In a preferred example, the blade 200 may extend approximately 0.025 to 0.125 inches beyond the horizontal plane of the bottom surface 227 of the base 226.

The blade body 201 is disposed within the track 280 such that the surfaces of the parallel sides 259*a* and 259*b* mate with the interior surfaces of the partitions 285*a* and 285*b*. As illustrated in the cross-sectional FIGS. 17A and 17B, the guiding flange 258 is a portion of the track 280 that connects the partitions 285*a* and 285*b* at midpoint relative to vertical of the track 280. The guiding flange 258 is perpendicularly disposed relative to the partitions 285*a* and 285*b* and is disposed within the first slot 275. As the blade 200 slides through the track 280 to couple to the accessory 210, the first slot 275 of the blade 200 receives the guiding flange 258 of the track 280. The guiding flange 258 helps secure the blade 200 to the accessory 210 by maintaining alignment of the blade 200 with the head 220 of the accessory 210. The perpendicularly disposed guiding flange 258 may also serve to support the blade 200 and keep the blade 200 from bending or shifting within the track 280 while the accessory 210 is in use.

The blade 200 attached to the accessory 210 may be useful for side-to-side and front-to-back cleaning when the fitting 222 is attached to a vacuum cleaner hose. By comparison to typical vacuum tools, which work in one back-and-forth directional movement, the accessory 210 coupled to a blade 200 permits the vacuum to agitate debris and dirt from the cleaning surface regardless of the direction the accessory 210 moves (i.e. side-to-side and back-and-forth). During side-to-side movement of the accessory 210, the blade 200 substantially divides the enclosed area 238 of the accessory 210 into to symmetrical compartments 284 and 286, guiding air flow paths 219 on either side of the blade body 201 before the air flow paths 219 join at the fitting inlet 236. Each of the compartments 284 and 286 is bound by a cleaning surface, one of the parallel sides 259*a* and 259*b* of the blade body 201, and the interior surfaces of the walls 228, 230*a*, 230*b*, and 232 of the head 220. The compartments 284 and 286 join at the back wall 232 of the head 220 where the back edge 276 of the blade 200 is disposed. The blade 200 is coplanar with a reference plane that divides the fitting 222 along the longitudinal axis J of the fitting 222 and that contains the longitudinal axis J of the fitting 222. The orientation of the blade 200 relative to the fitting 222 permits the accessory 210 to slide with less resistance in the forward-to-back movement than the side-to-side movement of the accessory 210. So configured, the blade 200 is positioned substantially parallel with the vacuum fluid flow path, allowing the debris to be equally drawn from either side 259*a* and 259*b* of the blade 200 regardless of the direction of the motion of the accessory 210. Additionally, the blade 200 is centrally and internally disposed within the head body 220 such that the debris agitated from the cleaning surface can be easily drawn into the fluid flow paths 217 and 219 of the accessory 210, no matter which direction the blade 200 is moved to agitate debris.

The blade 200 may be made of a durable and extrudable plastic, such as polyethylene, that may be formed by injection molding, thermoforming, or compression molding. The blade 200 may instead be formed of any other suitable and durable material including metal, fiberglass, or other similar materials, or any combination of these materials. Exemplary extrudable plastics include, but are not limited to, polyvinylchlorides, polyethylenes, polypropylenes, acetals, acrylics, nylons (polyamides), polystyrene, acrylonitrile butadiene styrenes, and polycarbonates. The durable and rigid bottom edge 278 of the second exemplary blade 200 is suitable for agitating and loosening dirt particles from carpet fibers. The blade 200 is illustrated as a unitary piece, however in another example, the blade 200 may be formed by attaching two or more pieces to form a unitary blade. For example, the top portion 264 may be made separately from the blade body 201 such that the tabs 291 are sized to receive the width W of the blade body 201. The blade body 201 may be attached to the top portion 264 by adhesive, friction fit, welding, or other suitable fastening means.

Figure 18A:
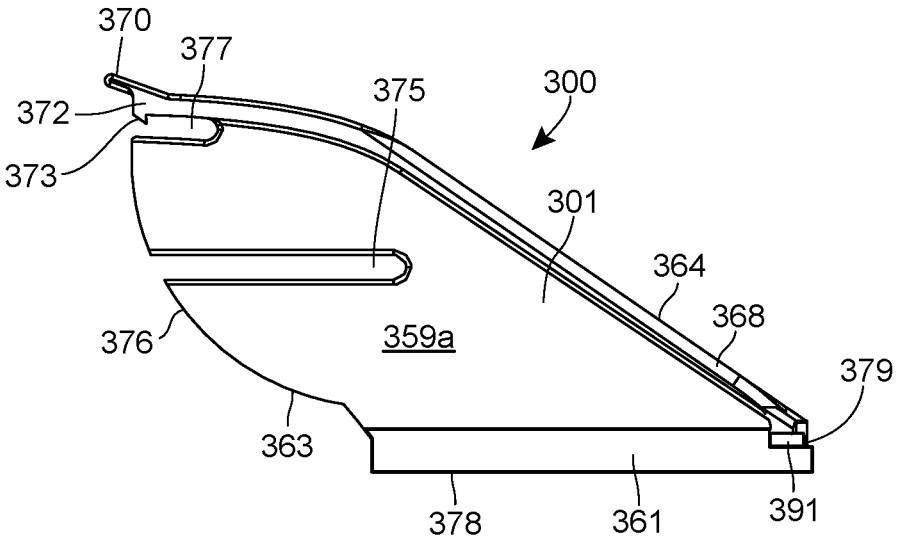
FIG. 18A is a side view of a third exemplary blade for use with the vacuum accessory of FIG. 12.
Figure 18B:
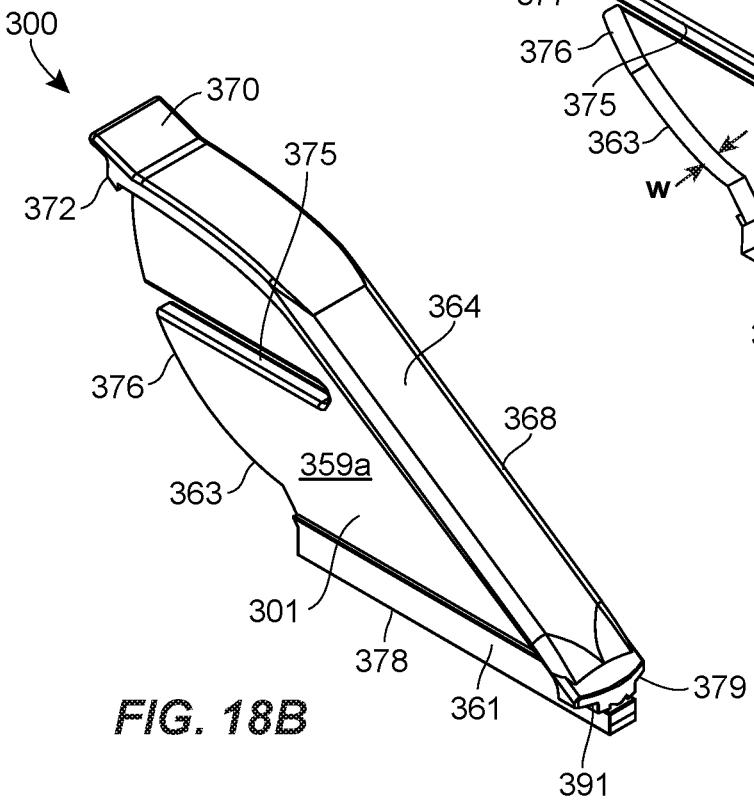
FIG. 18B is a front perspective view of the third exemplary blade of FIG. 18A.
Figure 18C:
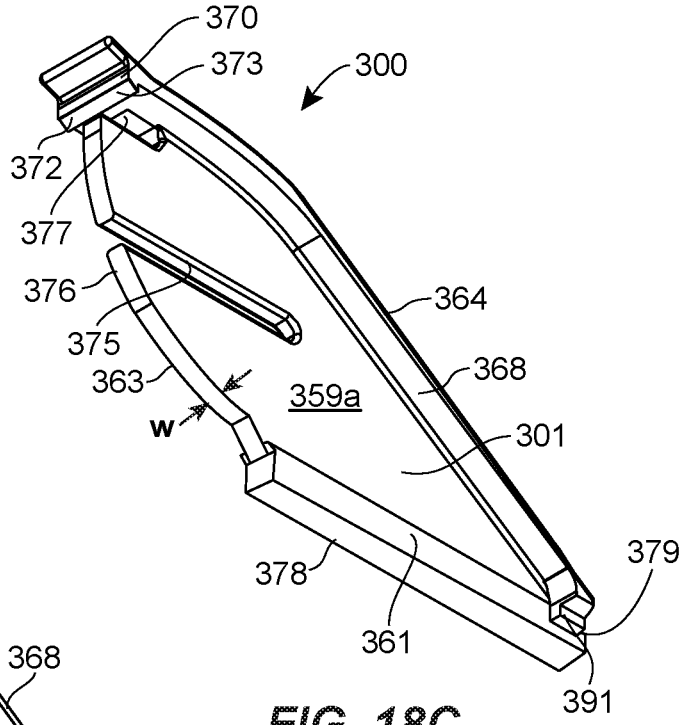
FIG. 18C is a back perspective view of the third exemplary blade of FIG. 18A.
Figure 19:
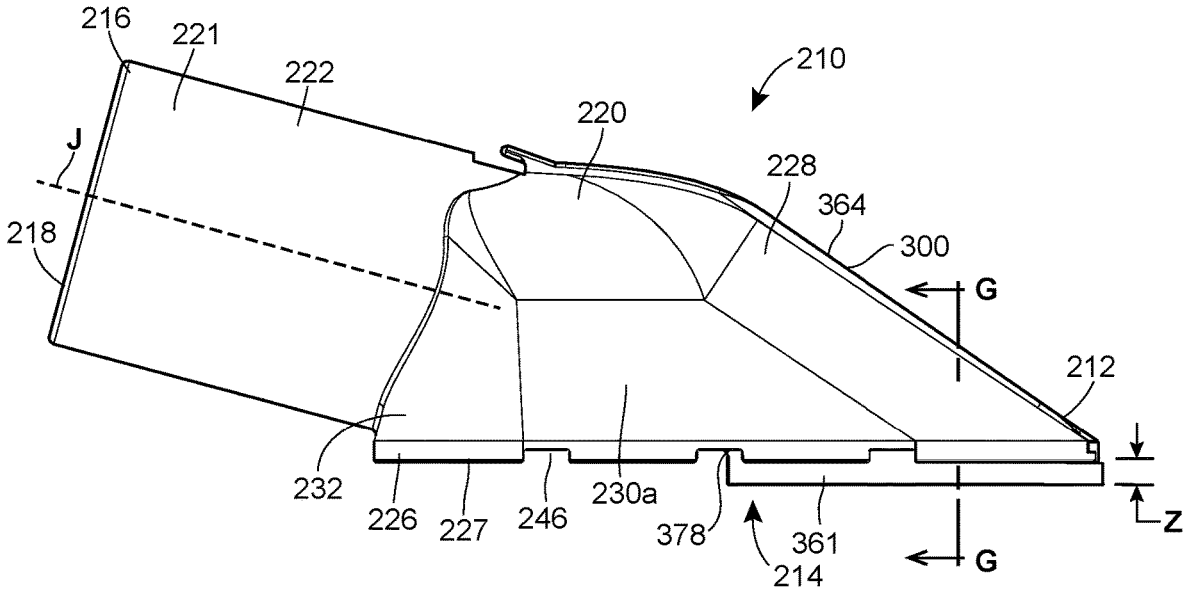
FIG. 19 is a side view of the third example vacuum accessory of FIG. 12 and the third exemplary blade of FIGS. 18A-C attached.
Figure 20:
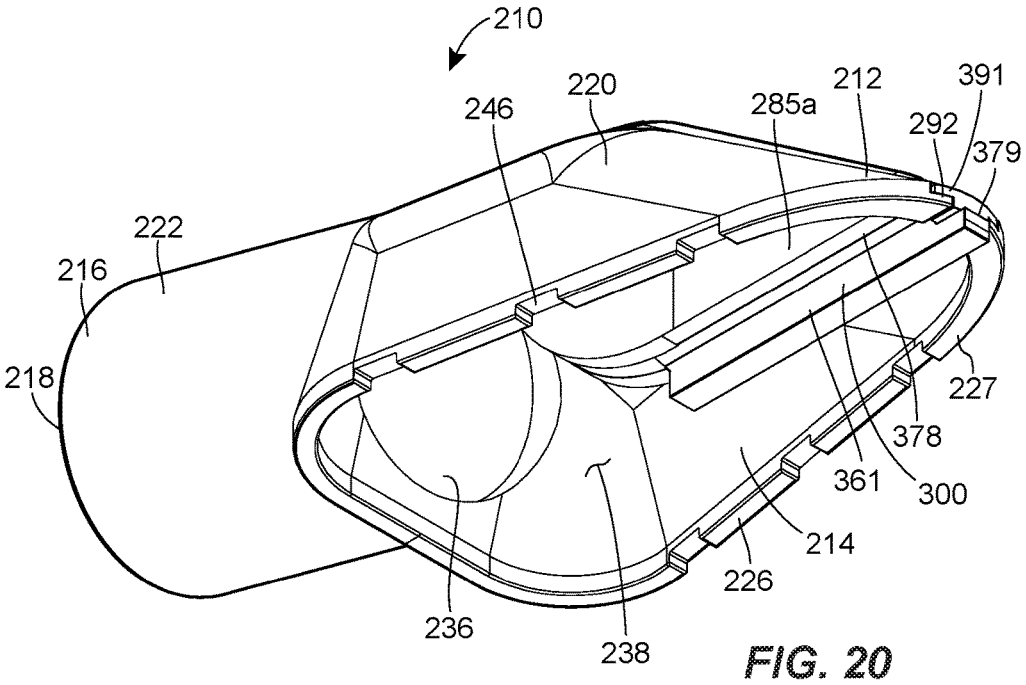
FIG. 20 is an interior perspective view of the vacuum accessory and attached blade of FIG. 19.
Figure 21A:
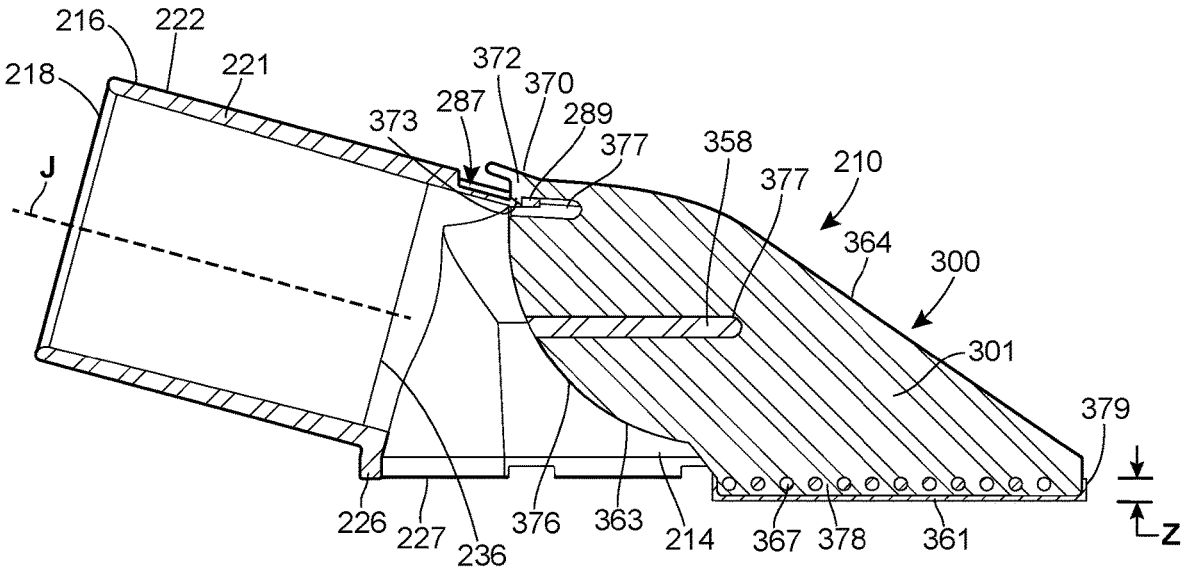
FIG. 21A is a cross-sectional view of the vacuum accessory and attached blade of FIG. 19.
Figure 21B:
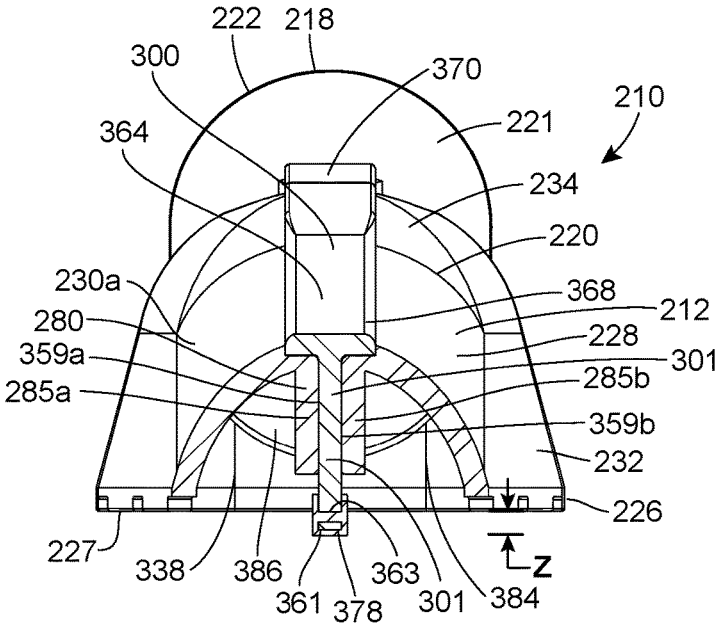
FIG. 21B is a cross-sectional view of the vacuum accessory and blade taken at G-G of FIG. 19.

In FIGS. 18A, B, and C, a third exemplary blade 300 is constructed in accordance with the teachings of the present disclosure. The third blade 300 is similar to the second exemplary blade 200 described above, except that the third blade 300 includes a different back edge 376 and a different bottom edge 378, particularly designed to pick up hair. Elements of the third blade 300 in FIGS. 18A-21B which are similar to the elements of the blade 200 are designated by the same reference numerals, incremented by 100. A description of many of these elements is abbreviated or even eliminated in the interest of brevity.

In the third exemplary blade 300, the bottom edge 378 includes a rubberized attachment 361, similar to the material of the pads 60 described above, to attract and grip hair and dust from a cleaning surface. The rubberized attachment 361 securely fastens to the bottom edge 378 of the blade body 301. The bottom edge 378 of the blade 300 includes a plurality of holes 367 to permit the rubberized attachment 361 to mold through the holes 367 and fasten over the bottom edge 378. For example, the bottom edge 378 is over molded with a natural gum rubber or similar soft durable rubber to form the rubberized attachment 361. During the molding process, the rubber material is extruded through the plurality of holes 367 so that the rubberized attachment 361 is fixed to the bottom edge 378 of the blade 300 when the molding process is complete. In other examples, a plurality of fasteners may be disposed through the rubberized attachment 361 and through the plurality of holes 367 to secure the rubberized attachment 361 to the bottom edge 378 of the blade 300.

The back edge 376 of the blade 300 provides a steeper curve perimeter 363 in comparison to the second exemplary blade 200 to further prevent clogging or tangling of dirt and debris. The rubberized attachment 361 is suitable for loosening, grabbing, and lifting pet hair from carpet fibers and into the range of suction of the accessory 210. The rubber attachment 361 is sized to extend a distance Z from the bottom surface 227 of the base 226 and may extend approximately 0.025 to 0.125 inches beyond a bottom surface 227 of the base 226, and preferably 0.08 inches.

The third exemplary blade 300 is preferably made of a combination of a durable plastic blade body 301 and a tacky rubberized attachment 361. The blade body 301 is preferably an extrudable plastic, such as polyethylene, that may be formed by injection molding, thermoforming, or compression molding. The material of the attachment 361 is not limited to natural gum rubber, and other examples of the blade 300 may include an attachment 361 made of other elastomers (e.g. latex), gels, woven fibers, or other suitable materials. The rubberized attachment 361 may be molded over the blade body 301 and formed by injection molding, thermoforming, or compression molding.

Figure 22A:
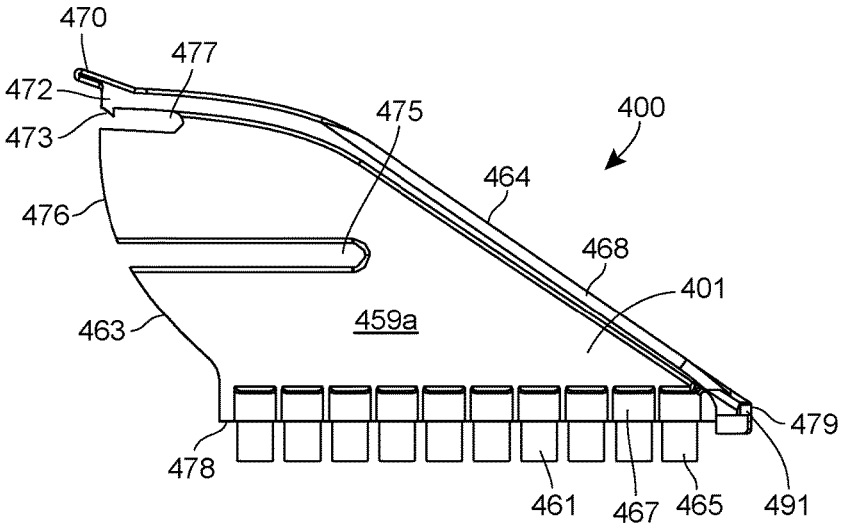
FIG. 22A is a side view of a fourth exemplary blade for use with the vacuum accessory of FIG. 12.
Figure 22B:
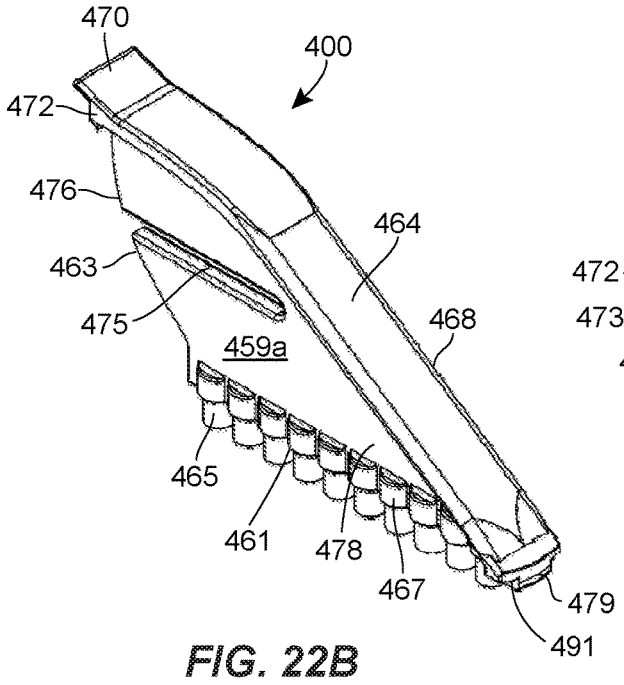
FIG. 22B is a front perspective view of the fourth exemplary blade of FIG. 22A.
Figure 22C:
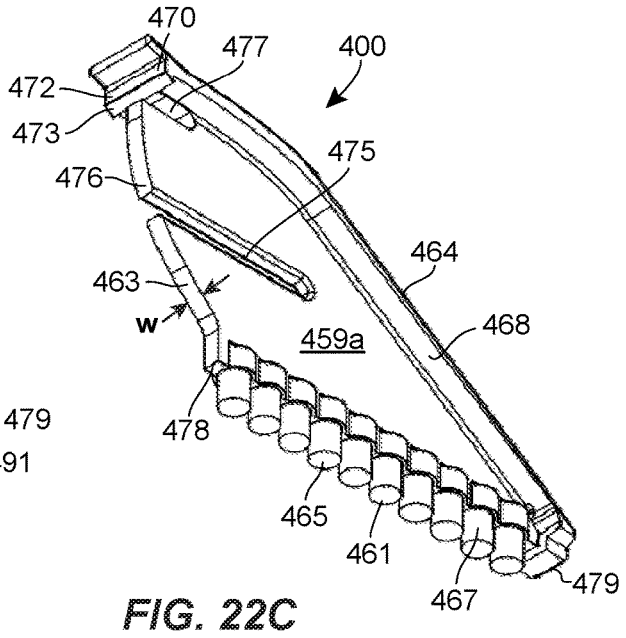
FIG. 22C is a back perspective view of the fourth exemplary blade of FIG. 22A.
Figure 23:
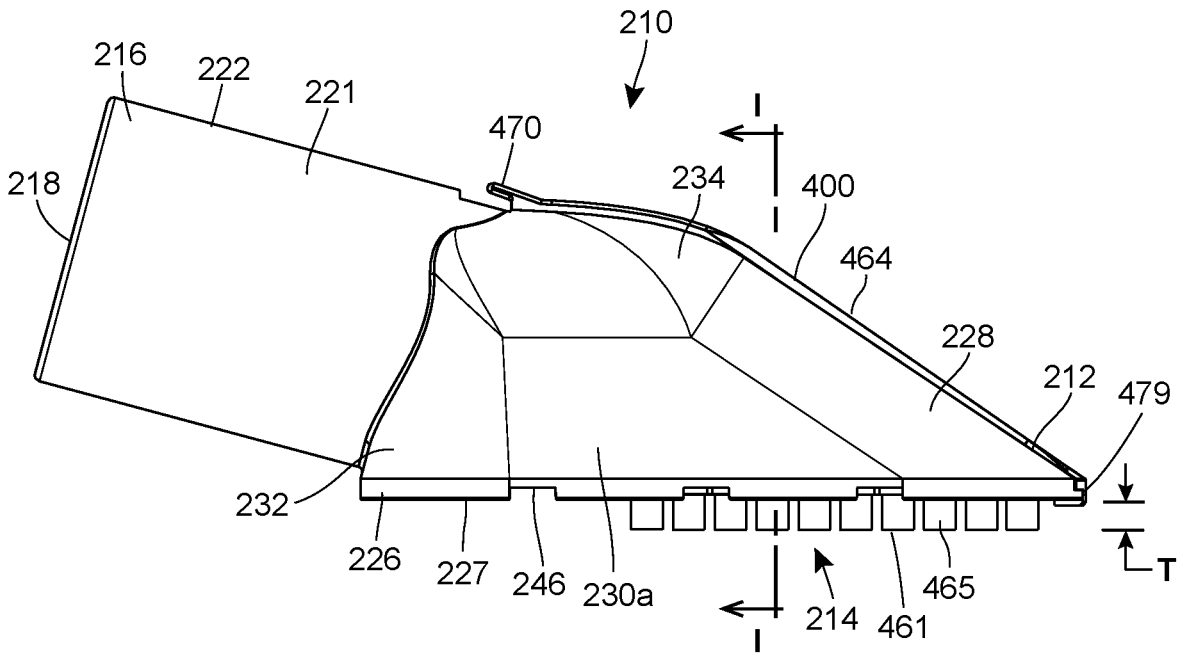
FIG. 23 is a side view of the third example vacuum accessory of FIG. 12 and the third exemplary blade of FIGS. 22A-C attached.
Figure 24:
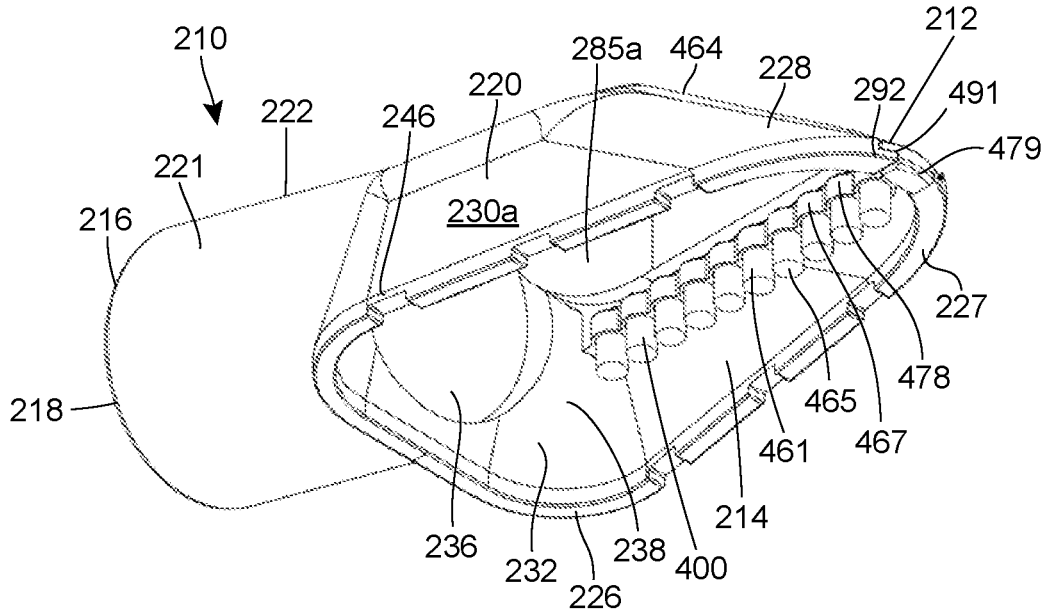
FIG. 24 is an interior perspective view of the vacuum accessory and attached blade of FIG. 23.
Figure 25A:
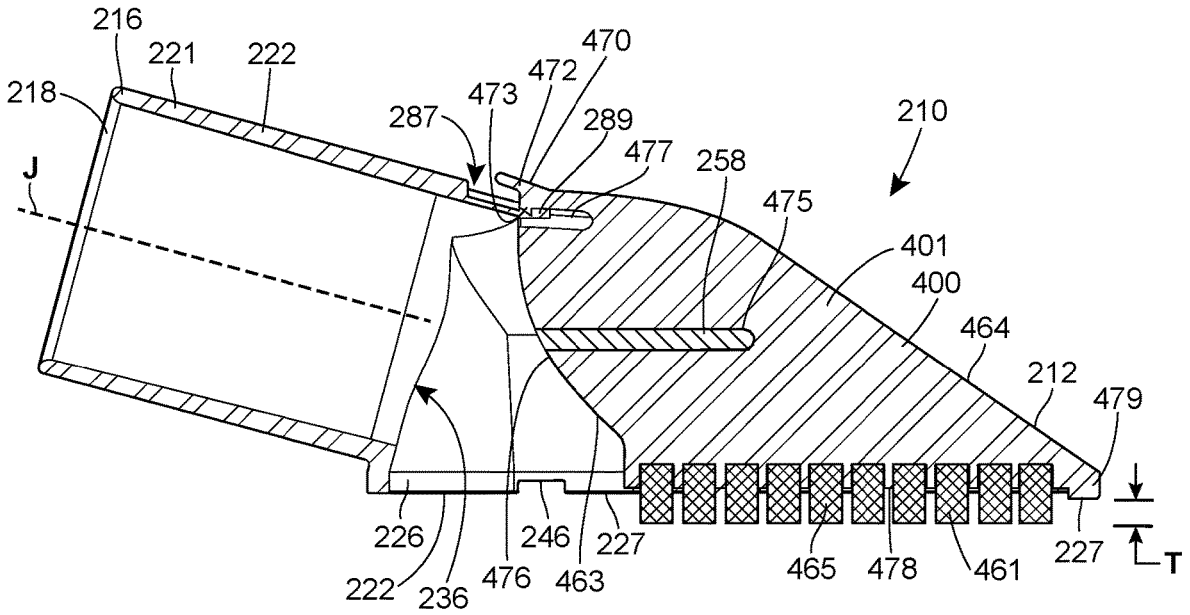
FIG. 25A is a cross-sectional view of the vacuum accessory and blade of FIG. 23.
Figure 25B:
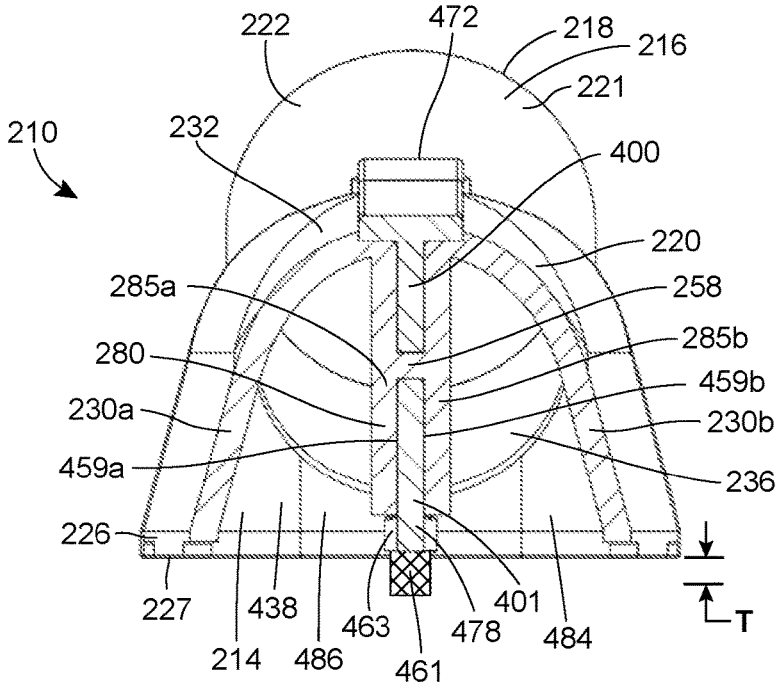
FIG. 25B is a cross-sectional view of the vacuum accessory and blade taken at I-I of FIG. 23.

In FIGS. 22A, B, and C, a fourth exemplary blade 400 is constructed in accordance with the teachings of the present disclosure. The fourth blade 400 is similar to the second exemplary blade 200 and the third exemplary blade 300 described above, except that the fourth blade 400 includes a different back edge 476 and a bristled bottom edge 478. Elements of the fourth blade 400 in FIGS. 22A-25B which are similar to the elements of the blades 200 and 300 are designated by the same reference numerals, incremented by 200 and 100, respectively. A description of many of these elements is abbreviated or even eliminated in the interest of brevity.

In the fourth exemplary blade 400, the bottom edge 478 includes a bristled attachment 461 made of a soft nylon or other similar and suitable materials for cleaning delicate surfaces. The bottom edge 478 includes a plurality of cylindrical orifices 467 or openings, where each cylindrical opening 467 is sized to receive a bristle group 465 or a plurality of bristles. Each bristle group 465 may be secured to the bottom edge 478 of the blade 400 by adhesive or by other fastening means. The bristled attachment 461 of the fourth exemplary blade 400 may be nylon or another material suitable for loosening dirt from delicate surfaces by gently lifting dust from the surface to facilitate dust suction toward the fitting inlet 236. In another example, the bristled attachment 461 may be a courser material, such as wire, to clean more durable surfaces. The bristle attachment 461 is sized to extend a distance T from the bottom surface 227 of the base 226. The bristle attachment 461 of the blade 400 may extend approximately 0.025 to 0.125 inches beyond the horizontal plane of the bottom surface 227 of the base 226, and preferably 0.10 inches beyond the horizontal plane.

The fourth exemplary blade 400 is preferably made of a combination of a durable plastic blade body 401 and a soft bristled attachment 461. The blade body 401 is preferably an extrudable plastic, such as polyethylene, that may be formed by injection molding, thermoforming, or compression molding. The material of the attachment 461 is not limited to soft nylon, and other examples of the blade 400 may include an attachment 461 made from natural, synthetic, or wire bristle materials, such as synthetic polymers, natural crimpled polypropylene, natural fibers, polyester, PTFE, PVC Quill, foam, styrene, or any combination of these materials.

The different blades 100, 200, 300, and 400 are exemplary and may be configured in any desired manner. For example, a blade according to the teachings of this disclosure may be customized to meet a specific cleaning need and may include different materials suitable for the cleaning surface. In other examples, the blade may include a different shape blade body, extending a different distance beyond the bottom edge, and/or including a different coupling mechanism between the accessory and the blade. The blades 100, 200, 300, and 400 may be permanently secured or attached to the accessories 110 and 210, or the blades may be removably attached or coupled to the accessories 110 and 210 such that a blade may be switched out of an accessory for another blade for a different use and/or purpose.

The figures and description provided herein depict and describe preferred examples of a vacuum accessory for purposes of illustration only. One skilled in the art will readily recognize from the foregoing discussion that alternative examples of the components illustrated herein may be employed without departing from the principles described herein. Thus, upon reading this disclosure, those of skill in the art will appreciate still additional alternative structural and functional designs for a vacuum accessory for a vacuum cleaner. Thus, while particular examples and applications have been illustrated and described, it is to be understood that the disclosed examples are not limited to the precise construction and components disclosed herein. Various modifications, changes and variations, which will be apparent to those skilled in the art, may be made in the arrangement, operation and details of the methods and components disclosed herein without departing from the spirit and scope defined in the appended claims.

What is claimed:

1. A vacuum accessory for use with a vacuum cleaner, the vacuum accessory comprising:

a head including a base, and a fitting interface, the head defining an inlet at the base and enclosing a cavity, the head extending from the fitting interface to the base;

a fitting connected to the head at the fitting interface of the head, the fitting symmetrically disposed about a longitudinal axis and defining an inlet and an outlet;

a fluid flow path fluidly connecting the inlet of the head and the outlet of the fitting;

a blade coupled to the head and at least partially disposed within the cavity of the head, the blade including a blade body having a bottom edge extending beyond the base of the head, the blade including a substantially planar body extending between a top edge and a bottom edge of the blade with the body extending to an outermost edge of the inlet and the bottom edge extending beyond the base of the head; and a reference plane bisecting the fitting and containing the longitudinal axis of the fitting, wherein the reference plane is coplanar with the body of the blade when the blade is coupled to the head so that the blade is positioned substantially parallel with the fluid flow path.

2. The vacuum accessory of claim 1, wherein the blade includes a back edge, the base includes a bottom surface, the body of the blade is centrally disposed within the cavity of the head, the top edge of the blade is coupled to the head, the back edge is disposed within the cavity of the head, and the bottom edge extends past a bottom surface of the base when the blade is coupled to the head.

3. The vacuum accessory of claim 2, wherein the head further comprises a track including a first end, a second end, and a slot connecting the first end and the second end, the track being sized to receive the top edge of the blade.

4. The vacuum accessory of claim 3, wherein the track includes a receiving aperture and the top edge of the blade includes a fastening member, the fastening member removably engaged with the receiving aperture at the first end of the track.

5. The vacuum accessory claim 2, wherein the bottom edge of the blade includes a rubber attachment configured to attract hair and other debris from a cleaning surface.

6. The vacuum accessory of claim 2, wherein the bottom edge of the blade includes a plurality of bristles.

7. The vacuum accessory of claim 1, wherein the fitting is configured to attach to a nozzle of a vacuum at the outlet defined by the fitting.

8. The vacuum accessory of claim 1, wherein the base is disposed on a plane and includes a rounded triangular-shaped perimeter.

9. The vacuum accessory of claim 1, wherein the head includes a plurality of walls forming the cavity, each of the plurality of walls having a top portion and a bottom edge, wherein the bottom edges of the plurality of walls form the base of the head and the top portions of the plurality of walls form the fitting interface.

10. The vacuum accessory of claim 9, wherein the head includes a cover portion defined by the plurality of top portions of the plurality of walls, and wherein head includes a leading portion, a first and second symmetrical side portions, and a back portion.

11. The vacuum accessory of claim 9, wherein the bottom edge of the blade extends beyond the bottom edges of the plurality of walls of the head in a direction perpendicular to the base.

12. The vacuum accessory of claim 3, wherein the blade mates with an exterior surface of the track.

13. A vacuum accessory for use with a vacuum cleaner, the vacuum accessory comprising:

a head having an inlet, a base proximal to the inlet, and a fitting interface, the head forming a cavity disposed between the inlet and the fitting interface;

a fitting attached to the head at the fitting interface of the head, the fitting including a fitting inlet and an outlet;

a fluid flow path fluidly connecting the inlet of the head and the outlet of the fitting; and a blade removably coupled to the head and at least partially disposed within the cavity of the head, the blade including a blade body having a bottom edge extending beyond the base of the head, wherein the head includes a plurality of walls forming the cavity, each of the plurality of walls having a top portion and a bottom edge, wherein the bottom edges of the plurality of walls form the base and the top portions of the plurality of walls form the fitting interface.

14. The vacuum accessory of claim 13, further including a reference plane dividing the fitting and intersecting with a longitudinal axis of the fitting, wherein the reference plane is parallel with the blade body when the blade is coupled to the head.

15. The vacuum accessory of claim 14, wherein the head comprises a track including a first end, a second end, and a slot connecting the first end and the second end, the track sized to receive a portion of the blade.

16. The vacuum accessory of claim 15, wherein the blade includes a deformable tab and at least one of the head and the fitting define an aperture that is sized to receive the deformable tab of the blade.

17. The vacuum accessory of claim 16, wherein the deformable tab includes an angled end adapted to engage with a portion of the head, the deformable tab adapted to deform outwardly away from blade body to disengage the angled end from the portion of the head the when the blade is decoupled from the head.

18. The vacuum accessory of claim 13, wherein the bottom edge of the blade includes a rubber attachment.

19. The vacuum accessory of claim 13, wherein the bottom edge of the blade includes a plurality of bristles.

20. The vacuum accessory of claim 13, wherein the fitting is configured to attach the head to a nozzle of a vacuum at the outlet of the fitting.

21. The vacuum accessory of claim 13, wherein the base includes a rounded triangular-shaped perimeter.

22. The vacuum accessory of claim 13, wherein the head includes a cover portion defined by the top portions of the plurality of walls, and wherein the plurality of walls include a leading portion, a first and second symmetrical side portions, and a back portion.

23. The vacuum accessory of claim 22, wherein the first and second symmetrical side portions are angled inwardly toward the cover portion.

24. The vacuum accessory of claim 13, wherein the bottom edge of the blade extends beyond the bottom edges of the plurality of walls of the head.

25. A vacuum accessory for use with a vacuum cleaner, the vacuum accessory comprising:

a head having an inlet, a base proximal to the inlet, and a fitting interface, the head forming a cavity disposed between the inlet and the fitting interface;

a fitting attached to the head at the fitting interface of the head, the fitting including a fitting inlet and an outlet;

a fluid flow path fluidly connecting the inlet of the head and the outlet of the fitting; and a blade removably coupled to the head, the blade including a blade body extending between a top edge and a bottom edge of the blade, the blade body at least partially disposed within the cavity of the head, the blade having a curved perimeter along a top portion, the top portion being contoured to match an interior perimeter of a top surface of the head.

* * * * *